US012780491B2

(12) United States Patent
Beelen et al.

(10) Patent No.: US 12,780,491 B2
(45) Date of Patent: Nov. 3, 2026

(54) CONSUMER PRODUCTS AND METHODS FOR OPERATING THE SAME

(71) Applicant: The Procter & Gamble Company, Cincinnati, OH (US)

(72) Inventors: Laurens Beelen, Mechelen (BE); Joseph Bohache, Milford, OH (US); Matthew Corcoran, Cincinnati, OH (US); Paulus Antonius Augustinus Hoefte, Astene (BE)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 18/969,354

(22) Filed: Dec. 5, 2024

(65) Prior Publication Data

US 2025/0187785 A1 Jun. 12, 2025

(30) Foreign Application Priority Data

Dec. 11, 2023 (EP) ..... 23215627

(51) Int. Cl.
*B65D 5/66* (2006.01)
*B65D 85/00* (2006.01)

(52) U.S. Cl.
CPC ..... *B65D 5/6608* (2013.01); *B65D 85/70* (2013.01)

(58) Field of Classification Search
CPC . B65D 5/68; B65D 5/685; B65D 5/38; B65D 5/4608; B65D 5/22; B65D 5/541
USPC ..... 206/468, 530–539, 1.5; 220/315, 323, 220/215; 229/125.125
See application file for complete search history.

(56) References Cited

U.S. PATENT DOCUMENTS 1,130,271 A * 3/1915 Hammond ..... B65D 5/685 206/815
2,711,282 A * 6/1955 Esposito ..... B65D 5/685 229/179
3,512,699 A * 5/1970 Wilson ..... B65D 5/0227 229/102
4,196,843 A * 4/1980 Garmon ..... B65D 5/685 229/165
4,304,355 A * 12/1981 Sykora ..... B65D 5/68 229/125.26

(Continued)

FOREIGN PATENT DOCUMENTS

FR 1495610 A 9/1967
WO 2023083939 A1 5/2023

OTHER PUBLICATIONS

EPO Search Report and Opinion for 23215627.3 dated May 21, 2024, 12 pages.

*Primary Examiner* — Chun Hoi Cheung
(74) *Attorney, Agent, or Firm* — Abigail O. Idokogi; Andrew J. Mueller

(57) ABSTRACT

A consumer product including a container and a detergent product contained therein, the container including: a box and a lid). A lock maintains the lid in a closed position. The lock includes an actuator releasably engaging the lid. The actuator may be actuated by applying an actuation pressure at an actuating area. A top flap is hinged at a top portion of a sidewall and is arranged with a distal edge distant from a second sidewall by a clearance. Upon applying the actuation pressure, the distal edge contacts the second sidewall and provides reciprocal feedback force or haptic feedback to the user.

20 Claims, 9 Drawing Sheets

(56) References Cited

U.S. PATENT DOCUMENTS

| | | | | |
|---|---|---|---|---|
| 6,484,931 | B1 * | 11/2002 | Hofte | B65D 5/6608 229/149 |
| 11,794,947 | B2 * | 10/2023 | Hoefte | B65D 5/445 |
| 11,932,468 | B2 * | 3/2024 | Hoefte | B65D 5/68 |
| 12,116,184 | B2 * | 10/2024 | Hoefte | B65D 5/685 |
| 12,162,651 | B2 * | 12/2024 | Hoefte | B65D 5/48014 |
| 2019/0135503 | A1 * | 5/2019 | De Wilde | B65D 50/046 |
| 2023/0103439 | A1 * | 4/2023 | Hoefte | B65B 5/024 206/525 |
| 2023/0113321 | A1 * | 4/2023 | Bressan | B65D 5/38 206/1.5 |
| 2023/0132541 | A1 * | 5/2023 | Hoefte | B65D 5/38 206/1.5 |
| 2023/0257145 | A1 | 8/2023 | Ruers et al. | |
| 2023/0264852 | A1 * | 8/2023 | Hoefte | B65D 5/38 206/1.5 |
| 2023/0264853 | A1 * | 8/2023 | Hoefte | B65D 5/566 229/125.26 |
| 2024/0294301 | A1 * | 9/2024 | Hoefte | B65D 5/685 |

* cited by examiner

CONSUMER PRODUCTS AND METHODS FOR OPERATING THE SAME

BACKGROUND

This invention generally relates to containers for detergent products. Such containers containing detergent products are consumer products present in consumer homes, in particular in rooms such as a kitchen, a laundry room or a bathroom, which tend to generate a humid environment. It is important that the container be configured to adequately protect the detergent product from degradation due to an excessive exposure to such moisture or humidity.

DETAILED DESCRIPTION

Figure 1:
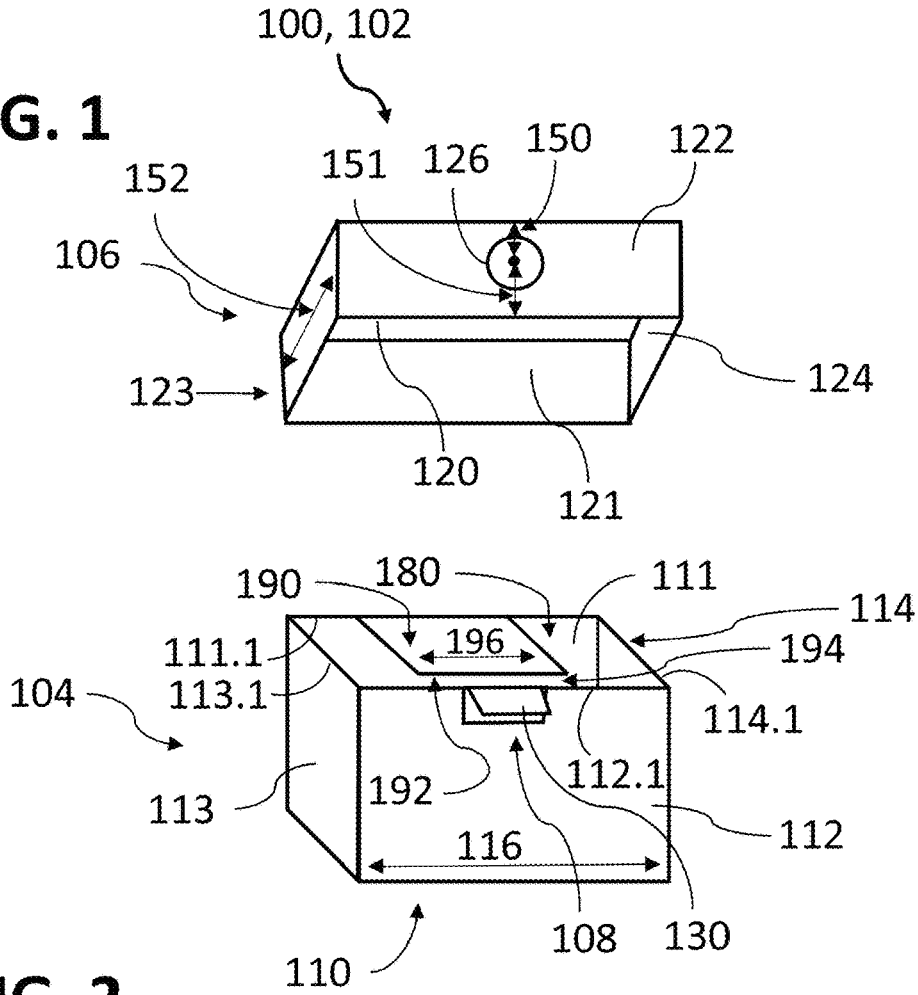
FIG. 1 illustrates an example consumer product.

Detergent products are sensitive to humidity. They should be contained in specifically designed containers, and in particular containers which may be properly locked or closed before and after use, to prevent the detergent composition from being overly exposed to environmental humidity. At the same time, the container must be easy to operate for an adult consumer. The opening/closing mechanism should thereby reliably prevent accidental opening while offering a reliable unlocking/locking operation for an adult consumer. Additionally, the amount of material that is to be used for manufacturing a container should be as low as possible for environmental reasons while simultaneously shielding the detergent product from humidity and ensuring its mechanical robustness. The container should also be reliable through-out its lifetime, including the case of a multiple usage package (e.g., reusable, refillable container). For the locking system to reliably operate, the container should be prevented from deforming beyond a point where the lock ceases to properly function.

As will be described below, the specific configuration described in this disclosure permits relying on a specific human gesture called "precision pinch". Precision pinch is a specific human hand gesture whereby a human pinches an object between his/her thumb and at least one or more other finger of the same hand. It was found that human beings are particularly precise when exerting such a movement. Precision may be described in this respect by considering the alignment of the direction of forces applied by the thumb and by the one or more other fingers of the same hand. When applying a precision pinch, the thumb generates a first force on a first side of the pinch, the one or more other finger generating a second (resulting) force on a second side of the pinch. Generally speaking, the first and the second forces are oriented substantially along the same axis, in opposite senses. The key point of the precision pinch is that the first and the second force will naturally align each other if there is a reciprocal feedback response between the thumb and the one or more other fingers from the same hand. As will be described below, the configurations proposed will enable such reciprocal feedback, leading to relying on a precision permitting reliable lock opening of an otherwise robust locking mechanism. As will be described below, specific dimensioning enables such configurations, in particular corresponding to an adult hand. It should indeed be understood that, in the present description, a hand corresponds to a human adult hand.

Detergent products are products which may be relatively heavy, for example when a container for such product is carrying the full weight of such detergent products, in particular when the consumer product is recently acquired and thereby holds a significant quantity of detergent product. While some consumers may lift and transport such a consumer product holding a base of a box containing such detergent product, such lifting and transport may also occur by holding such consumer product by a lid, without holding the base. In such cases, it is possible that the lid, submitted to the force of gravity of the detergent product, gets released and opens the box, the box falling and possibly spreading its content. Such situations should be avoided. Beyond avoiding such unintentional lid unlocking, the structure of the container of a consumer product should preserve or improve opening ergonomics and prevent or reduce a permanent side wall deformation upon excessive or repetitive application of forces applied to the consumer product, for example during transport, in a grocery shopping bag against other objects, when submitted to external pressure, or when dropped. At the same time, containers may be elaborated in order to preserve the environment. The consumer product according to this disclosure aims at taking these different aspects into account.

A consumer product should in this disclosure be understood as a product which is provided, among others, to end consumers. Such consumer products may for example be available for purchase in supermarkets and end consumers may store such consumer products in their homes. Consumer products may be provided in large quantities and environmental concerns should thereby be taken into consideration when designing the products. Consumer products should also be designed taking transportation to a retail store into account. Consumer products should also be robust so as to withstand transportation as part of an e-commerce shipment. Consumer products should also be designed taking on the shelf storage in a retail store into account. Consumer products should also be designed taking transportation from a retail store to a consumer home into account. Consumer products should also be designed taking storage at a private end-consumer home into account. Consumer products should also be designed taking use of the consumer product at a private end consumer home into account. Consumer products should also be designed taking disposal into account.

The consumer product according to this disclosure comprises a detergent product. Detergent products should be understood in this disclosure as products comprising a surfactant. Detergent products may also comprise a bleach or other ingredients. Example detergent product compositions are described in more detail herein below. In some examples, the detergent product comprises unit dose detergent pouches, preferably water-soluble unit dose detergent pouches, more preferably flexible water-soluble unit dose detergent pouches. Example unit dose detergent pouches are described in more detail herein below. One should note that in some cases, the containers according to this disclosure may also be suitable for content other than a detergent product, in particular for content of a perishable nature, such as food or unstable chemical substances for example.

In the present disclosure, the detergent product may be in direct contact with the container. In some examples, the detergent product is a powder or granular detergent. In some examples, the detergent product is constituted by unit doses made each of a water-soluble pouch enclosing a powder. If the detergent product is a powder, at least some powder particles contact the sidewalls, the base or the cover of the container. If the detergent product is a detergent unit dose, the water-soluble pouch enveloping the active product constitutes part of the detergent product, and at least some of the water-soluble pouches are in contact with the sidewalls, the base or the cover of the container. In other words, no intermediate body (film, insert, layer or material, etc.) separates the content of the container from the container.

Indeed, a further benefit of the present disclosure is that no further elements (film, insert, clip, tear strip) is required to properly conceal the detergent product. In particular, there is no need for a tear strip, these strips that are sometimes provided to allow the end user to divide two portions of a container, making it possible to open the container. Tear strips and other clips make the recycling of the container more cumbersome, and their absence is beneficial for the environment.

The consumer product according to this disclosure further comprises a container. A container should be understood in this disclosure as an object housing a content, for example in a cavity of the container. The container facilitates protection, transport, storage, access and disposal of the consumer product.

In this disclosure, the container comprises a box. A box should be understood as a generally parallelepiped, barrel shaped, cylindrical, round, oval or cubical three-dimensional object defining a cavity. The capacity of the box may be comprised between 500 ml and 7000 ml, or in some examples between 800 ml and 4000 ml. The box may have a maximum width comprised between 10 cm and 35 cm, a depth comprised between 5 cm and 13 cm and a height comprised between 8 cm and 40 cm. The use of parallelepiped boxes may facilitate storage and transportation by permitting piling up boxes in a space efficient manner. In some examples, a box may be a parallelepiped provided with some rounded, tapered trapezium or chamfered edges. The box according to this disclosure comprises the detergent product. It should be understood that the detergent product is contained or stored in the box directly, i.e., there is no intermediate layer or intermediate packaging separating the detergent product from the inner cavity of the box. When the detergent product is a detergent unit dose, the water-soluble pouch enveloping the active product constitutes part of the detergent product, i.e., there is no intermediate layer or intermediate packaging separating the box from the water-soluble pouch.

The box according to this disclosure comprises a base and sidewalls. A base according to this disclosure should be understood as a wall on which the container may lie when placed on a supporting surface such as a shelf or a floor. The base may be made from a plurality of flaps folded with respect to the sidewalls such that those flaps forming the base lie in a substantially coplanar manner or in substantially parallel planes. In some examples, the base is flat. In some examples, the base is rectangular. In some examples, the base is oval or round. In some examples, the base has an embossed profile standing in or out in relief. During the filling process of the container, and/or during shipment, and/or during storage, the container may be positioned upside down, i.e., the base being on top of the container. The container may also be positioned sideways, i.e., with one of the sidewalls being on top and/or one of the sidewalls being at the bottom.

The sidewalls according to this disclosure should be understood as extending from the base. In some examples, the sidewalls are perpendicular to the base. In some examples, the base is rectangular and has four sides, four sidewalls extending perpendicular from the base, each sidewall being rectangular, each side wall being connected by a sidewall side to a side of the base, and by two other sidewall sides to two other of the four sidewalls. In some examples, the base is oval or circular and the sidewalls form a generally cylindrical wall extending from the base in a direction normal or perpendicular to the base. In some examples, sidewalls have a shape corresponding to one of a square, a rectangle, a trapeze, a polygon, a section of a sphere, a section of an ovoid, or a section of an ellipsoid. Writing provided on sidewalls of the box are in some examples horizontally readable when the box is in a position of being used. The sidewalls and the base may form an inner cavity where the detergent product is received.

The sidewalls of the present disclosure have a respective top edge. The top edge should be understood as an edge delimiting an end of each sidewall, which end is at the top of the sidewall, as the container is arranged in a regular position with its base at the bottom.

Opposite the base, the container comprises an opening enabling access to the cavity delimited by the sidewalls and the base. In some examples, the opening spans an area of at least 10 cm2, preferably of at least 20 cm2. Such opening span may permit inserting fingers or even a hand in order to reach the inside of the box. In some examples whereby the detergent comprises water-soluble unit dose articles, the opening spans an area of between 1.1 and 10 times a largest cross sectional area of a water-soluble unit dose article. In some preferred examples, the opening spans an area of between 1.5 and 5 times of a largest cross sectional area of a water-soluble unit dose article contained in the container.

The container may further comprise at least one top flap, hinged to a top portion of a first one of the sidewalls. The top flap can assume at least two orientations, i.e., a closed orientation where the top flap covers at least part of the opening, and an open orientation, where the top flap is pivoted upwards and away from the opening, thereby not restricting access to the cavity and the detergent product received therein. The top flap comprises a distal edge, opposite the hinge, and the distal edge is distant from the second sidewall, opposite the first sidewall. The distance or clearance between the distal edge of the top flap and the second sidewall is sufficient to enable the top flap being freely movable between the closed orientation and the open orientation. The clearance is also sufficient for the actuation of a lock. As will be explained in more detail below, the clearance is smaller than a given threshold for preventing excessive deformation of the sidewalls when actuating the lid locking actuator. Indeed, to guarantee that the lock will function properly through-out the lifetime of the container, deformation of the sidewalls beyond their elastic deformation should be avoided. The upper limit of the clearance is also dictated by the need to provide a haptic feedback to the user. The clearance may be comprised between 0.1 mm and 5 mm.

In some examples, the top flap is made integrally with a sidewall and extends from a top edge of said sidewall. In some examples, the top flap comprises a main portion hinged to a proximal flap portion connected (for instance glued, stitched or integral) with the first sidewall. In some examples, the top flap (or its main portion) is offset with respect to the top edge, when in the closed orientation. In some examples, the offset is in the direction of the base: the top flap in the closed orientation is closer to the base than are the top edges of the sidewalls.

In some examples, a distal flap is hinged and protrudes from the distal edge. In some examples, the distal flap is substantially parallel to the second sidewall when the top flap is in the closed orientation. The distal flap may be folded towards the top edge of the second sidewall or may be folded towards the base.

In some examples, the top flap's movement is restrained by at least one abutment and/or at least one stopper. In some examples, the stopper prevents the top flap from moving further downwards after the top flap has reached its closed orientation. In some examples, the abutment restraints the upward movement of the top flap as the top flap is in the closed orientation. In some examples, the abutment is arranged in the second sidewall, for instance at the top edge or at an internal surface of the second sidewall. In some examples, the abutment is a cut-out portion of the second sidewall. In some examples, the stopper is a recess arranged in an internal surface of the second sidewall.

In some examples, the distal edge of the top flap comprises a recess or a notch. In some examples, the recess or notch is aligned or centered with respect to the specific actuator. In some examples, as the actuation pressure is applied, the second sidewall contacts the distal edge of the top flap at at least two contact locations, the at least two contact locations being non-contiguous and potentially separated from one another by the recess or notch. The distance separating the two contact locations may be comprised between 5% and 30% of a width of the container. In some examples, more than one recesses are foreseen. In some examples, the distal edge has a wave or corrugated profile, constituted by a series of recesses, regularly or irregularly distanced from one another. In some examples, the recess or notch extends from the distal end to the first sidewall, thereby materializing that the top flap is made of two independently hinged portions. In other words, two or more top flaps are provided.

In some examples, two or more top flaps are provided and are hinged to either a same top portion of the first sidewall, or at least one of the two or more top flaps may be hinged to a top portion of a second sidewall, opposite the first sidewall. Each one of the two or more top flaps may contain the features listed in the previous paragraphs. In some examples, the two or more top flaps are spaced apart so as to enable a human hand to pass through the opening between the top flaps to grasp detergent product contained in the box.

In some examples, as the top flap is in the closed orientation, the top flap is hinged to the first sidewall such that a resisting torque comprised between 0.5 N·m/m of crease and 5 N·m/m of crease opposes its movement out of the closed orientation. The resisting torque may be a combination of at least one of: the hinge resistance (for instance resulting from the bending resistance potentially diminished by the remaining springback after creasing and folding of the top flap); and the previously mentioned abutment(s) or stopper(s). The springback torque of the top flap may be taken under consideration. In some examples, the top flap is made of a paper-based material having flutes. The flutes may be of type B (⅛"), E (1/16") or F (1/32"). In some examples, the folding torque may be comprised between 0.5 and 5 Nm/m of crease; preferably between 1 and 3.5 Nm/m of crease and the Spring back torque (after 15 sec) may be comprised between 0.4 and 2 Nm/m of crease, preferably between 0.7 and 1.25 Nm/m of crease. These values may be measured in accordance with the Tappi T577 Standard, using samples of 100*100 mm (crease perpendicular to the flute) and a fold rate of 12°/s and a folding angle of 90°. Based on the above-mentioned width of the box, this means that the folding torque of the top flap may be comprised between 0.1 Nm and 1.75 Nm and the spring back torque of the top flap may be comprised between 0.07 Nm and 0.6125 Nm. The stopper and/or abutment may provide a resisting torque of 0.57 Nm to 5.6125 Nm.

In some examples, the first sidewall has a width and the top flap has a minimum width that is comprised between 20% and 99% of the width of the first sidewall. The width of the first sidewall may correspond to the length of the top edge of the first sidewall.

In some examples, the top flap comprises at least one through-hole enabling an adult finger to fold the top flap open. In some examples, the hole has a surface area comprised between 0.5 $cm^2$ and 15 $cm^2$.

In some examples, in the closed orientation, the top flap is angled with respect to the second sidewall at an angle comprised between 70 degrees and 110 degrees.

In some examples, the top flap comprises a main flap portion and an inclined flap portion angled downwards with respect to the main portion. In some examples, the inclined flap portion has a slanted edge adjacent the distal edge to facilitate the insertion of the top flap in the cavity/through the opening, as the top flap is folded downwards. In some examples, the inclined flap portion comprises a straight edge abutting against the first sidewall as the top flap is in the closed orientation. This prevents the top flap from being pressed too deep inside the box.

The top flap may have a top surface that is visible to a user as the lid is open. This top surface may be provided with printed or labelled product information or usage instructions. The top flap may then constitute, beyond the sidewalls, the lid and/or the base, as an additional support for advertisement, usage instructions or other regulatory or informative indications. In some examples, it may be beneficial for the user to be provided with some information directly as the user sees the open box and its content. The top flap may comprise perforations at the hinge point so that it can be torn off by the consumer (for instance at the end of life). In some examples, the top flap may be printed with promotional instructions or barcodes such that the torn-off top flap become a coupon or promotion card for a further purchase by the user.

In some examples, the actuator is formed by cutting off at least one portion of the top flap, folding this at least one portion in a position parallel to the first sidewall and gluing the at least one portion to an external surface of the first sidewall.

The container comprises a lid for the box. The lid according to this disclosure should be understood as an element permitting to repeatedly close or open the opening of the box. In some examples the lid may be connected to the box, for example by a hinge, or may be separated from the box. The lid according to this disclosure comprises a top or lid top and flanks or lid flanks. It should be understood that the top of the lid is aimed at covering the opening of the box when the lid is in a closed position. In some examples, the top of the lid is rectangular. In some examples the top of the lid is round, hexagonal, octagonal, polygonal or oval, structures such as round or oval being for example approximated by multiplying a number of side panels and lid flaps. In some examples, the lid comprises beveled edges. In some examples, the top of the lid is rectangular with rounded edges. It should be understood that while being named "top", the top of the lid may be positioned in different orientations. As for the lid flanks, it should be understood that the flanks according to this disclosure are elements connected to the top of the lid and extending from the lid in order to engage (e.g., partly cover) one or more sidewalls of the box, each flank having an extension along a corresponding sidewall between the connection to the top of the lid and a distal end of the flank. The flanks participate in placing the top of the lid onto the opening. In some examples, the flanks extend perpendicularly from the top of the lid. In some examples, the flanks surround an entire perimeter of the top of the lid. In some examples, the flanks partially surround an entire perimeter of the top of the lid, a portion of the top of the lid being flank-less, for example along a hinge between the lid and the box in a case of a hinged lid. As the top of the lid covers the opening, at least a portion of the flanks may cover at least a specific portion of a specific sidewall of the sidewalls of the box. Movement of the lid may be restrained by a connection to the box such as a hinge, or a flexible connector (strip, rope, etc.), or the lid may be entirely removable, for example to provide an improved access to the content of the box, or to allow the lid or the container to be independently reusable. The box and lid cooperate to participate in fulfilling the role of the container to store, transport and facilitate access to the content of the container.

The container according to this disclosure comprises a lock. A lock should be understood in this disclosure as a mechanism preventing or reducing the likelihood of opening the container by accident. The lock according to this disclosure is intended to maintain the lid in a closed position. It should be understood that the lock according to this disclosure is expected to function under normal use of the container. It should be understood that the lock may not fulfill its function when for example unusual use is made of the box, or when the box is under unusual conditions. According to this disclosure, the lock comprises a specific actuator moveable from a locking position to an opening position by applying an actuation pressure onto the specific actuator when the lid is in the closed position. The specific actuator should be understood in this disclosure as a mechanical structure submitted to a movement upon actuation by an outside force or actuation pressure, such movement leading to the opening of the lock when such movement takes place. In some examples, the specific actuator according to this disclosure is resilient and has a default position, such default position corresponding to the lid remaining closed, a resilience being vanquished by an outside force or actuation pressure in order to open the lid. In some examples, the specific actuator is resilient in the sense that the specific actuator comprises a flexible element, the flexible element having a default position corresponding to the lid remaining closed, the flexible element being pressed to open the lid, the flexible element springing back to the default position when releasing pressure. It should be understood that a pressure is generated by the application of a force onto a surface. The specific actuator according to this disclosure has at least two positions being the opening position and the locking position, whereby the opening position corresponds to a position permitting displacement (opening) of the lid, the locking position preventing opening of the lid or reducing the possibility of an accidental opening of the lid.

The specific actuator according to this disclosure is connected to the specific portion being the at least specific portion of a specific sidewall of the sidewalls of the box covered by at least a portion of the flanks when the lid is in the closed position, which may be a specific portion covered by at least a portion of the flanks when the lid is in the closed position, the specific actuator abutting for example against a locking tab of the flanks when in the locking position, the specific actuator being for example maintained away from the locking tab when in the opening position, the specific actuator being for example displaceable by the actuation pressure by an unlocking displacement distance in a direction normal to the specific portion of the sidewalls. The connection to the specific portion may for example be a fold line at an end of a sidewall away from the base. The connection of the specific actuator to the specific portion of the sidewall is due to the specific actuator participating in locking or unlocking the specific portion of the sidewall from the portion of the flanks covering the specific portion of the sidewall, thereby permitting releasing the lid from the box. The flanks may comprise a locking tab. A locking tab should be understood as a mechanical element which interlocks with the specific actuator. In some examples the locking tab extends away from the flanks and may be in the form of a bulge, a ridge, an embossment or an additional material layer sticking out of the flanks of the lid and towards the specific portion of the side wall such that the specific actuator may abut against the tab when in the locking position to prevent separating the specific portion of the sidewalls from the flank in the area of the specific actuator. In some examples, the locking tab is comprised in the flank itself, the locking tab being for example formed by an aperture in the flanks. Abutment according to this disclosure should be understood as a contact between the specific actuator or part of the specific actuator and the tab, such contact preventing opening of the lid. In some examples the specific actuator is maintained away from the locking tab when in the opening position, in order to release the locking tab. Such release of the locking tab permits opening the lid. Displacement or movement of the specific actuator from the locking to the opening position is obtained by application on the specific actuator (directly or indirectly) of an actuation pressure or force such that the specific actuator is displaced by a distance sufficient to contact of the specific actuator with the locking tab, such distance corresponding to the displacement distance, in a direction normal to the specific portion of the side wall. It should be understood that due to the specific dimension configuration according to this disclosure, the force or pressure leading to the displacement will take a specific direction defined by the precision pinching, such specific direction contributing to the displacement in a direction normal to the specific portion of the side wall. Such force or pressure may also comprise a minor component which may be parallel to the side wall, due to the fact that the hand is a human hand which does not necessarily align force completely perfectly, even when applying a precision pinch. The actuation is however triggered by a component of such force or pressure being normal to the portion of the side wall. Such presence of a component normal to the portion of the sidewall participates in the role of the lock of avoiding an accidental opening, whereas desired opening would take place by the consumer "pushing" the specific actuator and apply the unlocking force or pressure permitting opening of the lid.

In order to provide precision in locating a finger appropriately and obtain a precision pinch, the flanks comprise a specific actuation area in a specific flank, the actuation area facing the specific actuator. The fact that such actuation area faces the specific actuator indeed permits locating either the thumb or one or more of the other fingers on exactly the area on which a lock opening force should be applied. The actuation area should be understood as defining a discontinuity on the specific flank, whereby a user or consumer may perceive such discontinuity in order to correctly locate the thumb or one or more other fingers and apply the precision pinch. Such discontinuity may comprise one or more of an actuation aperture, an actuation flap, an actuation slit or an actuation membrane. In some examples, the actuation area, meaning either one or both of the specific or additional actuation area, the specific portion, or the additional portion, comprises a visual indication indicating the location of the actuation area. In some examples whereby the actuation area is an aperture, the specific portion, respectively additional portion, comprises a visual indication visible through the aperture, respectively apertures, when the lid is closed. The visual indication may be printed on an external surface of the flanks and may comprise one or more arrows or one or more areas printed in a striking colour or a specific text providing instructions such as "push here to open" for example, or a combination of any of these indications, in order to further increase precision of pinching. The actuation area is configured to permit displacing the specific actuator from the locking position to the opening position by applying the actuation pressure at the specific actuation area when the lid is in the closed position. In order to appropriately place the thumb or one or more other fingers, the specific actuation area preferably spans less than 8 cm2 and more than 0.2 cm2. It was found that a larger area may lead to lack of precision in finger placement, and that a smaller area may lead to the actuation area being difficult to locate for a user or consumer. In some examples, the specific actuation area has a circular shape in order to ease positioning. Other shapes may be considered such as, for example, elliptical, oval, square, triangular, square with rounded corners, triangular with rounded corners, other polygonal shapes or other polygonal shapes with rounded corners. Alternatively, a shape that is significant for the content held in the container may be used.

In some examples, the lock comprises a second actuator provided opposite the first actuator. Hence, the user may operate simultaneously the specific actuator and the second actuator with two of his/her fingers. In some examples, the lock comprises at least a further actuator, which may be actuated simultaneously with three or more fingers of the user's hand. For instance, the first actuator may be arranged on one side of the box to be actuated by the thumb, and two to four actuators may be arranged on the opposite side of the box to be actuated with two to four fingers, other than the thumb. The actuators may not be aligned opposite one another.

As mentioned above, in order to reach an appropriate precision in precision pinch, the thumb should perceive a reaction force from the one or more fingers of the same hand, and the one or more fingers should perceive a reaction force from the thumb. This reciprocal feedback will lead to aligning the forces produced during the precision pinch leading to the opening of the lock. Such feedback should be transmitted by some structure which would directly or indirectly connect the specific actuation area with the flank opposite the specific flank. It was found that the role of such a structure transmitting the feedback forces could be fulfilled by the top flap mentioned above. As the actuator is displaced of the unlocking displacement distance, the second sidewall is deformed and the clearance between the distal edge of the top flap and the second sidewall is reduced. The clearance is sufficient to enable the actuator being displaced of the unlocking displacement distance. As the user applies the actuation pressure, the sidewall is further deformed until the second sidewall contacts the distal edge of the top flap. The force applied by the user is thus transmitted from a first finger to the actuator, to the distal edge of the top flap, to the first sidewall and to another finger of the user. The relative positioning of the specific area and of the top flap enables this transmission of force. In some examples, the thumb and one or more other fingers enter in contact simultaneously with the specific actuator and with the opposite sidewall which are linked through the top flap.

The specific actuation area may define a specific centroid, a centroid corresponding for example to a geometric centre of the actuation area or arithmetic mean position of all the points comprised in the specific actuation area. In order to achieve adequate reciprocal feedback transmission through the top flap, the specific centroid is separated from the top of the lid by less than 5 cm and by more than 0.5 cm and the specific centroid is separated from a distal end of the specific flank by more than 0.5 cm. The distal end should be understood as the end of the flank away from the top of the lid along the direction of the box sidewalls. In some preferred examples, in order to facilitate pinching across the top of the lid, the top of the lid spans less than 13 cm and more than 6 cm along a direction normal to the specific portion at the specific centroid. It was found that a larger span could render pinching difficult, and that a smaller span my render difficult accessing the detergent contained in the box. Precision pinch is believed to provide an appropriate balance of power and precision for the purpose of opening the lock according to this disclosure. In some examples, the top of the lid spans less than 12 cm and more than 7 cm along a direction normal to the specific portion at the specific centroid. In some examples, the top of the lid spans less than 11 cm and more than 8 cm along a direction normal to the specific portion at the specific centroid. In some examples, the top of the lid spans less than 10 cm and more than 9 cm along a direction normal to the specific portion at the specific centroid.

In some examples, in order to appropriately transmit the reciprocal feedback pinching force, the top flap has a minimum width of at least 5%, preferably at least 10%, more preferably at least 20%, of a length of a top edge of the first or second sidewall. The width of the top flap may be less equal to or less than 99%, less than 70%, preferably less than 60%, more preferably less than 50% of the length of the top edge of the first or second sidewall, so as to limit the amount of material used (environment-friendly) and potentially offer an access to (or visually show) the product even as the top flap is in the closed orientation.

A tamper evident sticker may be locking a lid to the box. In some examples a tamper evident sticker is glued on the lid and on the box, whereby the tamper evident sticker should be broken, teared or perforated at first opening to indicate to a consumer that the container has not been tempered with before purchase. This temper evident sticker may for example be in paper or in plastic.

In some examples, the container is made of corrugated material comprising flutes extending in a longitudinal direction corresponding to a vertical direction of the sidewall in a normal position of the container. This may provide a springback memory effect for the top flap and may assist the opening of the top flap.

In some examples, the box of the present disclosure is made from a box blank. The box blank can be made from one of the material or layered materials discussed hereby. A blank (or die cut) is a substantially flat object that is specifically designed to be fed to a machine that can perform various operations, such as folding, gluing or the like, such as to obtain a container. A blank may be made of one piece of the above-mentioned material or may comprise several pieces attached together. A blank has a thickness that is substantially smaller than its overall width or length. The thickness may be homogeneous through-out the entirety of the blank or the thickness may vary. The blank may be constituted of one or more panels and one or more flaps, separated from each other by crease lines. Crease lines should be understood as linear segments of the blank which have endured a creasing process, so as to offer well-defined folding lines, which facilitate the folding operation and provide the conditions for the container to obtain its intended shape and function.

In some examples, the lid is made from a lid blank. The lid blank may comprise panels configured to build the top of the lid and the flanks of the lid. The lid blank may be distinct and separate from the box blank. In such a case, the lid blank may be made from the same paper-based material, or from a distinct paper-based material. In particular, the lid blank may be of a different color, or may be made from a multi-layer blank having a different number of layers than a single or multi-layer box blank.

In some examples where the lid is hinged to the box, the lid blank may be integrally made with the blank configured to form the box.

The present disclosure also relates to methods for operating the container described above. A first method aims at opening the consumer product. In some examples, the method comprises applying an actuation pressure at the specific actuation area as the lid is in the closed position to displace the specific actuator from the locking position to the opening position, wherein the clearance is such that by applying the actuation pressure, the second sidewall contacts the distal end; pulling the lid in a direction opposite the base; and folding up the top flap to enable access to the detergent product. A second method aims at closing the consumer product by performing the same steps in a reverse order.

In some examples, as the actuation pressure is applied by an adult hand, the second sidewall bends until contacting the distal edge, and the top flap has a stiffness or bending resistance that is sufficient for stopping the second sidewall from bending further under the actuation pressure applied by the adult hand.

The present disclosure also pertains to a method for packaging a detergent product to obtain a consumer product as recited previously. In some examples, the method comprises setting the top flap in an open orientation; placing the opening of the box below a dispensing system as the top flap is in the open orientation; dispensing the detergent product into the box as the box is below the dispensing system; folding the top flap down into the closed orientation as the detergent product is in the box; and closing the box with the lid in response to folding the top flap. The top flap may assist the packaging of the container by providing an additional wall (similar to part of a funnel) that prevents detergent product from falling aside or being damaged.

DETAILED DESCRIPTION OF THE FIGURES

The figures present various aspects of a consumer product. Each distinct aspect presented in one of the figures can be combined with aspects presented in other figures, unless the present document explicitly excludes such combination.

FIG. 1 illustrates an example consumer product 100 comprising a detergent product (not visible) and a container 102, the container comprising a box 104 containing the detergent product, a lid 106 for the box 104, and a lock 108 to maintain the lid 104 in a closed position. In this illustration, the lid 106 is represented in an open position, remote from the box 104. Also in this illustration, the lid 106 is detachable from the box 104. In alternative examples, the lid 106 is hinged to the box 104. The box comprises a base 110, sidewalls 111-114, an opening 180 opposite the base 110, and a top flap 190 partially covering the opening 180 here (as it is in a closed orientation). The opening 180 is delimited by the top edges 111.1, 112.1, 113.1 and 114.1 of the four sidewalls 111-114. The top flap 190 is hinged to a top portion of the first sidewall 111. A distal edge 192, opposite the first sidewall is adjacent the second sidewall 112. A gap 194 or clearance, separates the distal edge 192 from the second sidewall 112 as the top flap 190 lies in the closed orientation. The clearance 194 may be comprised between 0.1 mm and 5 mm. The distal edge 192 has a length 196 which may correspond to the maximum width of the top flap 190. The length 196 may be comprised between 5% (preferably 20%) and 99% (preferably 60% or 70%) of the width 116 of the box 104.

The lid 106 comprises a top 120 and flanks 121-124, the top 120 covering the opening and the flanks 121-124 covering at least a specific portion of a specific sidewall of the sidewalls 111-114 of the box 104 when the lid 106 is in the closed position, the lock 108 comprises a specific actuator 130 moveable from a locking position to an opening position by applying an actuation pressure onto the specific actuator 130 when the lid 106 is in the closed position, the specific actuator 130 being connected to the specific portion, the flanks 121-124 comprising a specific actuation area 126 in a specific flank 122, the actuation area 126 facing the specific actuator 130 and permitting displacing the specific actuator 130 from the locking position to the opening position by applying the actuation pressure at the specific actuation area 126 when the lid 104 is in the closed position.

In the illustrated example of the consumer product 100, the box 104 has a rectangular base 110 and the lid 106 has a rectangular top 120. The sidewalls and flanks are also rectangular. In this example, the lid is illustrated in the open position in order to visualize the various elements. In this example, the actuation area 126 is a round aperture having a diameter of 2.4 cm which defines a specific actuation area of about 4.5 cm2. Actuation area 126 defines a specific centroid which corresponds to the center of the round aperture. In this example, the center of the aperture is separated from the top of the lid by about 20 mm as illustrated by distance 150 which is the shortest distance between the specific centroid and a point comprised in the top of the lid, the distance in this case being along a direction perpendicular to the top of the lid and along flank 122 into which the aperture 126 is cut out. The specific centroid, or center of round actuation area 126, is in this example separated from a distal end of the specific flank by 50 mm as illustrated by distance 151 which is the shortest distance between the specific centroid and a point comprised in the distal end of flank 122 of the lid, the distance in this case being along a direction perpendicular to the top of the lid and along flank 122 into which the aperture 126 is cut out. In this example, the top of the lid spans 94 mm along a direction normal to the specific portion at the specific centroid, as illustrated by distance 152 which in this case is parallel to the top of the lid and normal to the specific flank 122 where the specific actuation area is located. In this example, the lock 108 comprises a flap 130 which may be pushed through the aperture 126 when the lid is in the closed position. Lid 106 may be removed by, with a first adult hand, placing either the thumb or any other finger on the actuation area 126, and the opposite finger or fingers of the same adult hand on the flank 121 opposite the specific flank, the first adult hand thereby pinching the lid 106 across its top 120 and pushing onto flap 130 while holding the box 104 with the other adult hand to lift the lid open as the flap 130 remains pressed against the specific portion of the second sidewall 112.

As the first adult hand pinches the lid 106, a reciprocal feedback response is transmitted during pinching through the top flap 190 of the box, specifically through the distal edge 192 of the top flap 190 contacting the second sidewall 112. Such reciprocal feedback response contributes to facilitating the unlocking, in particular by increasing the rigidity of the box structure at the level of the top flap. It provides haptic feedback to the user who naturally and intuitively understands that the lock is unlocked and that he/she can pull the lid upwards. In this specific example, as the second sidewall 112 (and potentially also the first sidewall 111) deforms under application of the actuation pressure, the top flap joins at least a part of the specific (first) sidewall 111 to at least part of the second sidewall 112. Such configuration provides additional rigidity and robustness, facilitating transmittal of the reciprocal feedback response. The top flap 190 is conveniently aligned with the specific actuator 130. The top flap 190 may or may not be centered with respect to the width direction of the container.

The clearance 194 between the distal edge 192 of the top flap 190 and the second sidewall 112 is sufficiently large to allow the actuator 130 to be released from a locking tab of the lid. The clearance 194 is small enough to enable good haptic force feedback. Also, the clearance 194 is sufficiently small to avoid the sidewalls 111, 112 from being deformed beyond their elastic deformation (otherwise these sidewalls would be permanently deformed and this may alter the proper functioning of the lock or alter the smooth closing/opening process of the container).

Figure 2:
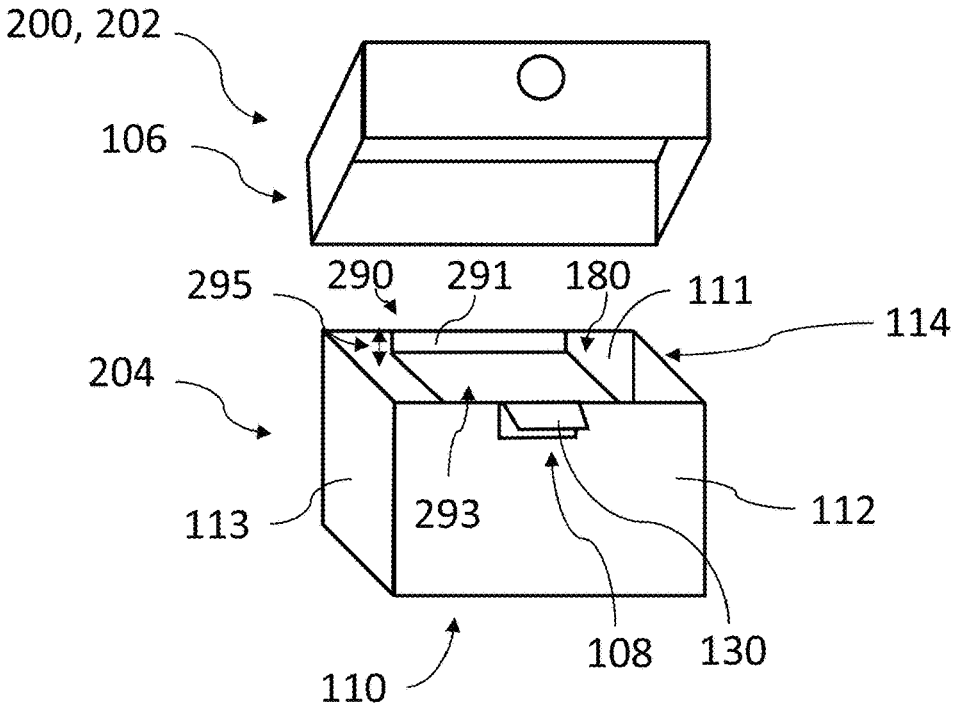
FIG. 2 illustrates an example consumer product.

FIG. 2 shows an example of a consumer product 200 with a container 202 made of a box 204 and a lid 106. The various aspects of the box and lid discussed in relation to the previous figure may apply. In this example, the top flap is noted 290. The top flap 290 is made of a proximal flap portion 291 that is connected to the first sidewall 111. The proximal flap portion 291 can be integral with the first sidewall. Alternatively, the proximal flap portion can be glued to an inner surface of the first sidewall 111. The proximal flap portion 291 may be aligned with the top edge of the first sidewall 111 or may be offset downwards in the direction of the base 110. The main flap portion 293 is hinged to the proximal flap portion 291. The main flap portion 293 can be pivoted from the closed orientation (as shown) to the open orientation, where the main flap portion 293 may be substantially vertical and/or substantially parallel to the proximal portion 291. On this illustration, the distal end of the top flap 290 is hidden behind the second sidewall 112. The main flap portion 293 is offset by a distance 295 with respect to the top edge of the sidewalls. This offset ensures that even if the top flap is not perfectly horizontal when in the closed orientation, the distal end will still contact the second sidewall under actuation pressure, to perform the reciprocal feedback force discussed above. The offset distance 295 can be comprised between 5 mm and 30 mm. In some examples, the offset distance 295 is such that when the main portion is in the open orientation, the main portion surpasses the top edges of the sidewalls by a height that is at least half the height of the lid, such that it would be noticeable to the user intending to close the container by putting the lid back on the box without having first folded down the top flap 290.

Figure 3:
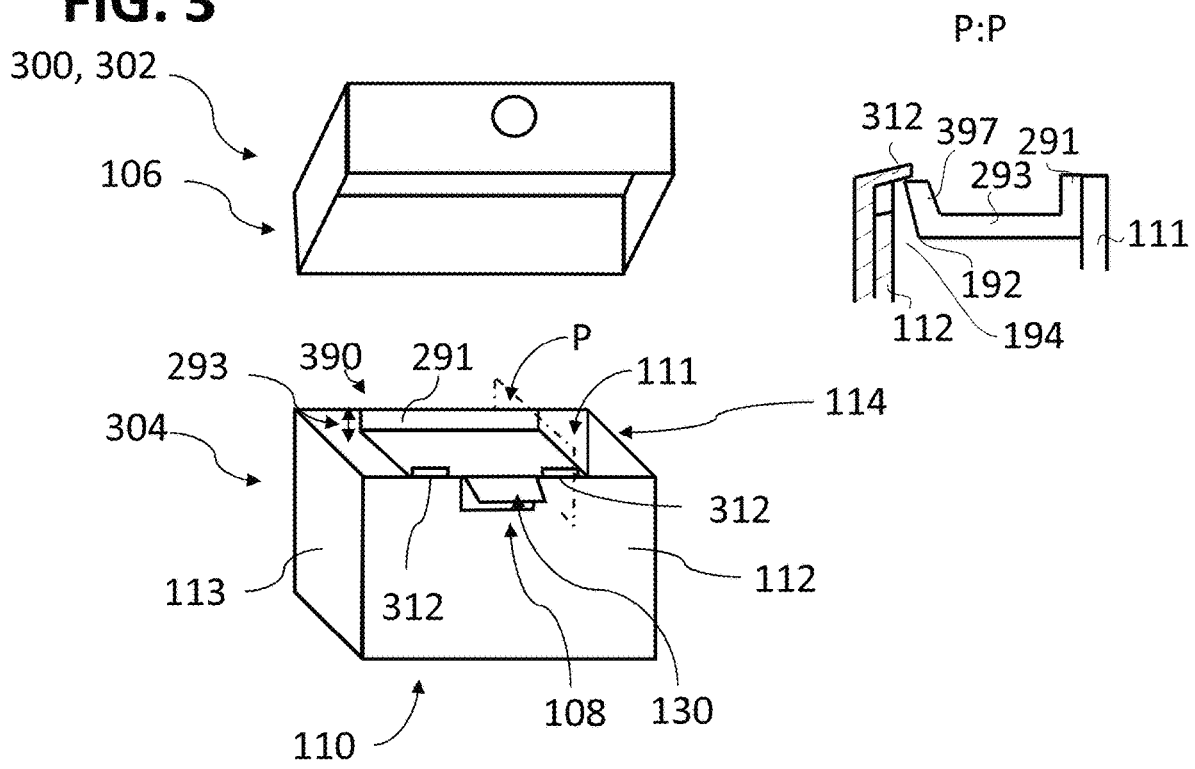
FIG. 3 illustrates an example consumer product.

FIG. 3 shows an example of a consumer product 300 with a container 302 made of a box 304 and a lid 106. The various aspects of the box and lid discussed in relation to the previous figures may apply.

In this example, the box 304 contains abutments 312 which aim at restricting an upward movement of the top flap 390 out of the closed orientation. As illustrated in a cross-section view in a vertical plan P, the abutment 312 may be a cut-out portion of the sidewall 112: the sidewall may be made of a two-layer, folded sheet, and a portion of the two-layer sheet may be cut-out at the top edge of the sidewall 112.

The top flap 190 of FIG. 1 and especially the distal edge 192 can cooperate with the abutment 312. In the illustrated example of FIG. 3 however, the top flap 390 comprises a distal flap 397, which cooperates with the abutment(s) 312. In some examples, the distal flap 397 is hinged to the distal edge 192 and extends from the main flap portion 293. The distal flap 397 extends upwardly, either perpendicularly to the main flap portion 293, or angled so as to be closer to the second sidewall 112 than the distal edge 192 of the flap 390.

In some examples, two or more abutments 312 are provided at the top edge of the sidewall 112. The abutments 312 may be centered and/or symmetrically arranged with respect to the top flap 390. These abutments 312 can provide a clicking sound when the top flap is snapped behind them which gives the consumer, besides the haptic feedback, audible reassurance of correct reclosing.

Figure 4:
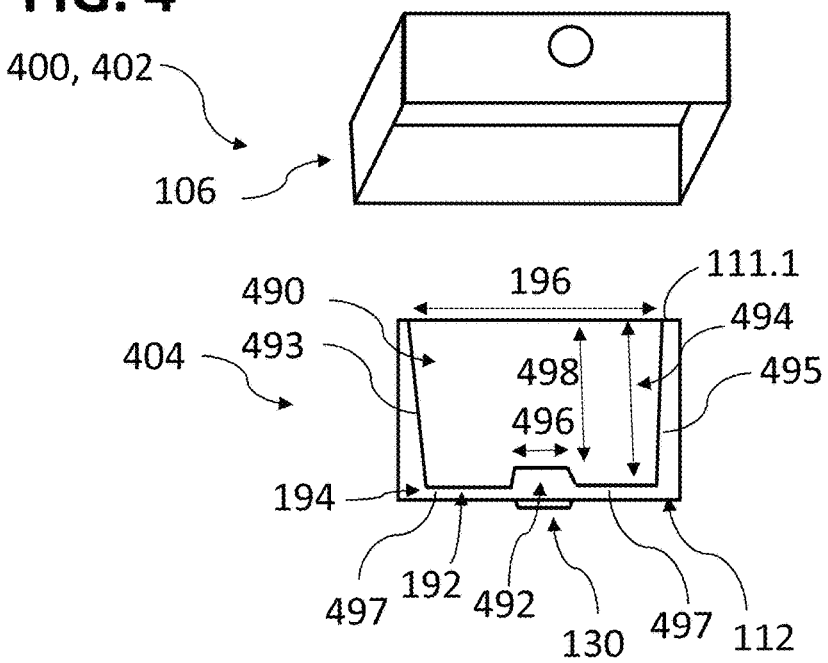
FIG. 4 illustrates an example consumer product.

FIG. 4 shows an example of a consumer product 400 with a container 402 made of a box 404 and a lid 106. The various aspects of the box and lid discussed in relation to the previous figures may apply. The box 404 is here seen from a top view.

The top flap 490 is positioned in a closed orientation. The top flap 490 comprises a recess 492 arranged at the distal edge 192, preferably aligned with the actuator 130 (a vertical axis on FIG. 4 would pass through both the recess and the actuator). The top flap 490 has two lateral edges 493, 495 which may be angled relative to the distal edge 192 of an angled comprised between 60° and 150°. The corners joining the lateral edges to the distal edge 192 may be rounded. These aspects are applicable to any of the top flaps illustrated in the present disclosure.

The Top flap 490 further comprises a recess 492. The recess 492 may help the user folding the top flap upwards in an open orientation. The recess 492 may be a notch. The recess 492 has a depth (in the vertical direction of FIG. 4) that can be comprised between 5% and 100% of the length 494 of the top flap 490. In other words, the dimension 498 between the top edge 111.1 of the first sidewall and the recess is comprised between 0% and 95% of the length 494 of the top flap 490. When the distance is 0%, the top flap 490 can be considered as being formed by two top flaps, independently hinged to a top portion of the first sidewall.

The width 496 of the recess may be comprised between 10% and 50% of the maximum width 196 of the top flap 490.

In some examples, the top flap 490 comprises more than one of such recesses, for instance two or three recesses, which can have one or more of the properties discussed above.

The recess divides the distal edge 192 into a plurality of segments 497, each one constituting a distinct contact location with the second sidewall 112 when the actuation pressure is exerted on the actuator 130. More than two contact locations 497 may be arranged when more than one recess is provided, each of the contact locations being non-contiguous to the other contact locations. Each contact location 497 is distant from the actuator 130 by a distance comprised between 5% and 30% of the width of the box (=length of the top edges 111.1 or 112.1).

Figure 5:
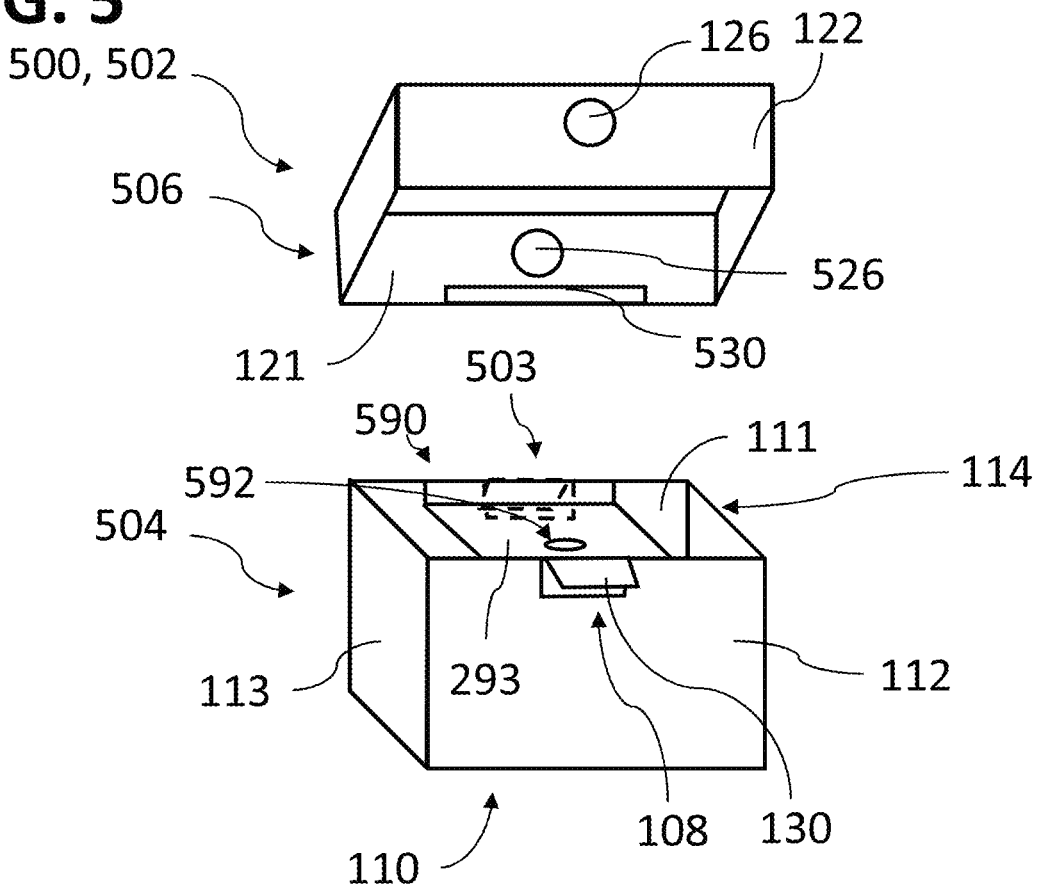
FIG. 5 illustrates an example consumer product.

FIG. 5 illustrates an example consumer product 500 with a container 502 made of a box 504 and a lid 506. The various aspects of the box and lid discussed in relation to the previous figures may apply.

In this example, the consumer product 500 comprises a second actuator 503, arranged on the first sidewall 111. The second actuator 503 is represented with a flap similar to flap 130 which interacts with a tab 530 placed on the inside of flank 121 to reinforce the locking of the lid. A second actuation area 526 is arranged on the flank 121.

Pinching will in this case unlock both the first and second actuator. While the tab is illustrated as spanning a portion of the corresponding flank 121, tabs may span an entire length of the corresponding flap. A tab (not visible) is provided on the inside of flank 122 to interact with flap 130 and contribute to the locking. One should note that while the second actuator 503 is represented as symmetrically opposed to the first actuator 130 and as having the same nature and dimensions, such actuators may take in other examples different natures and dimensions, and may not necessarily be symmetrical. As noted above, there may be more than two actuators, aligned or not opposite each other.

FIG. 5 further illustrates that the top flap 590 may have a through-hole 592. The through-hole 592 may be suited for an adult finger, so as to help the user pivot the top flap 590 from the closed orientation (as drawn on FIG. 5) to an open orientation (for instance substantially parallel to sidewall 111).

In some examples, the through-hole has a dimension (diameter, diagonal, etc.) of less than 10 cm, preferably less than 5 cm. In some examples, the shape of the through-hole is smaller than the content of the container (e.g., unit doses) to prevent any material from exiting through or being stuck in, the through-hole. Alternatively, the through-hole may be substantially bigger than the content of the container (e.g., unit doses) to enable the user to grasp a unit dose through the through-hole without having to first fold the top flap up.

The through-hole 592 may have a geometric shape such as a circle, an ellipse, a rectangle, etc. It may alternatively be shaped as a more complex shape, for instance as a comb-like handle, with a wave-like profile matching the profile of the four fingers of a human hand. The through-hole 592 may be positioned closer to the distal edge of the top flap than to the first sidewall 111, so as to offer a lever effect.

Figure 6:
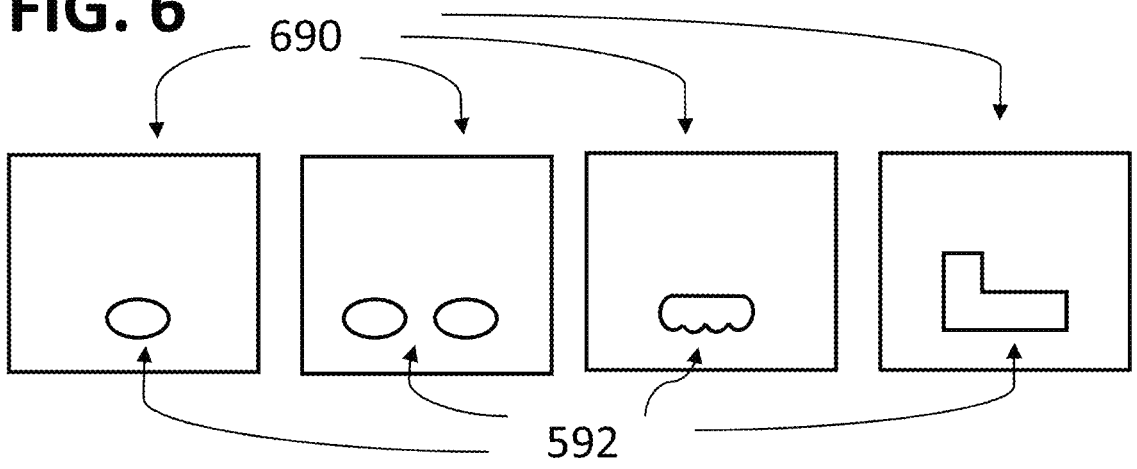
FIG. 6 illustrates examples of through-holes.

FIG. 6 shows these various options for the shape of the through-hole 592. FIG. 6 also illustrates that more than one through-hole can be provided to the top flap 690.

Figure 7:
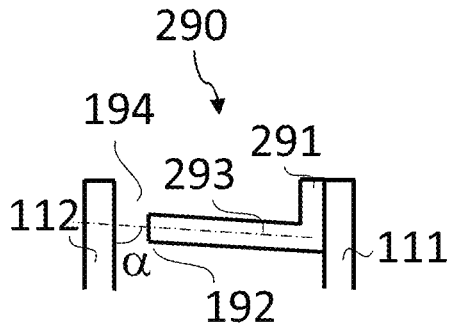
FIG. 7 illustrates an example of a top flap.

FIG. 7 illustrates a top flap 290 in a closed orientation. The various aspects of the box and lid discussed in relation to the previous figures may apply. The closed orientation may be the default balanced position of the top flap 290, i.e., a position of equilibrium between the gravity and the elasticity of the hinge. In some examples (see FIG. 3), an abutment determines the balanced position. The angle $\alpha$ between the top flap 290 (or in the illustrated case the main flap portion 293) and the second sidewall 112 can be comprised between 70° and 110°. This means that the reciprocal feedback force can be created even if the closed orientation of the top flap 290 is not horizontal or perpendicular to the sidewalls.

Figure 8:
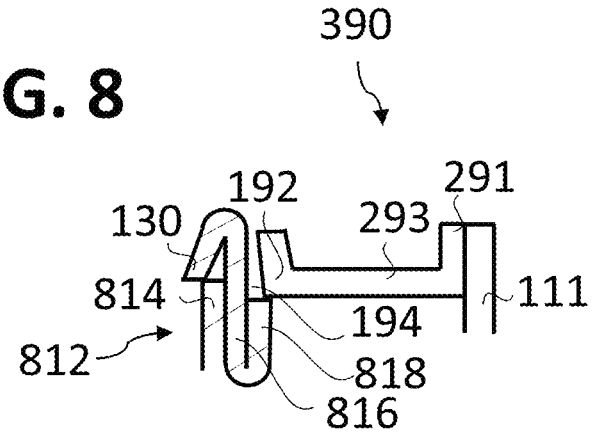
FIG. 8 illustrates an example of a top flap.

FIG. 8 shows a cross-section of an example of box. The various aspects of the box and lid discussed in relation to the previous figures may apply. The top flap 390 may be in accordance with any of the previously presented examples. In this example, the second sidewall 812 is made at least in part of a folded sheet. As discussed below, the sheet may be made of a paper-based material. A first, outer layer 814 is folded at the top edge to form an inner layer 816. Part or all of the inner layer 816 may be folded to form one or more stopper tabs 818. The stopper tab 818 protrudes in the box from an internal surface of the second sidewall 812. As shown on FIG. 8, the top flap 390 may lie on the stopper tab 818, in particular in the vicinity of the distal edge 192 of the top flap 390. The stopper tab 818 prevents therefore the user from pushing down the top flap beyond the closed orientation. Indeed, should the top flap 390 be forced downwards, the reciprocal feedback force may not be properly generated as the user attempts to apply the actuation pressure. The stopper tab 818 may extend along the entire width of the box, or along at least 30% of this width. In some examples, two or more stopper tabs 818 are arranged and are formed from cut-outs of the inner layer 816.

Figure 9:
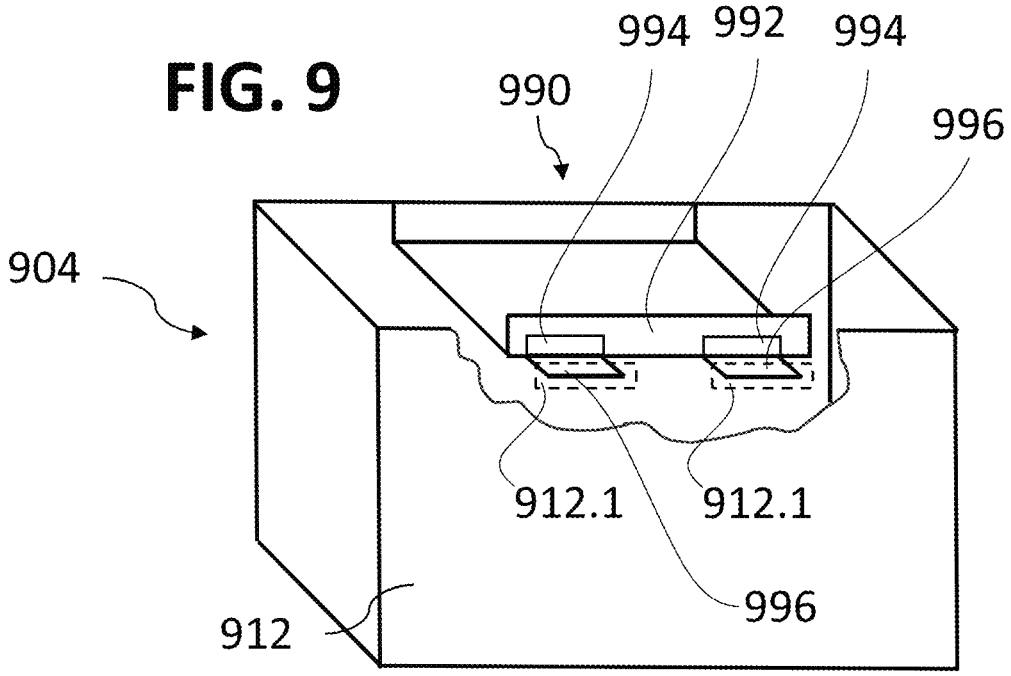
FIG. 9 illustrates an example of a box.

FIG. 9 shows a further example of stoppers. The various aspects of the box and lid discussed in relation to the previous figures may apply. In this example, the box 904 has a top flap 990 that comprises a distal flap 992 which is bent upwards from the main flap portion. The distal flap 992 comprises at least one, preferably two or more, cut-outs 994 forming protruding tabs 996 which engage a stopper recess 912.1 in the second sidewall 912, as the top flap 990 lies in the closed orientation. FIG. 9 shows an example with two protruding tabs 996 engaging a respective recess 912.1. Other arrangements may be foreseen, e.g., where more than one protruding tab 996 engages a single recess 912.1. The stopper recess 912.1 may be a notch, a through-hole, or a cavity, formed through-out the entire thickness of the second sidewall 912, or formed in an inner layer of material (see 816 on FIG. 8). The recess 912.1 may not be visible for the user from outside the box. The cooperation of the protruding tabs 996 with the recess 912.1 creates a resisting force that prevents an accidental movement of the top flap 990 out of the closed orientation. The stopper recess 912.1 generates haptic feedback and/or audible clicking sound to the user when the protruding tabs 996 engages therein. The user thus perceives physically the information in his/her hand that the top flap is properly positioned in the closed orientation. The recess 912.1 also discourages the user from pushing the top flap 990 further down, similar to the stopper 818 of FIG. 8, with which it can be combined.

With respect to FIGS. 8 and 9, it has to be noted that the stopper(s) does not necessarily prevent the possibility to move the top flap further down beyond the closed orientation, but it creates a resisting force which discourages the user from pushing the top flap further down, even though should the user apply a sufficient force, the top flap may bend further down.

Figure 10:
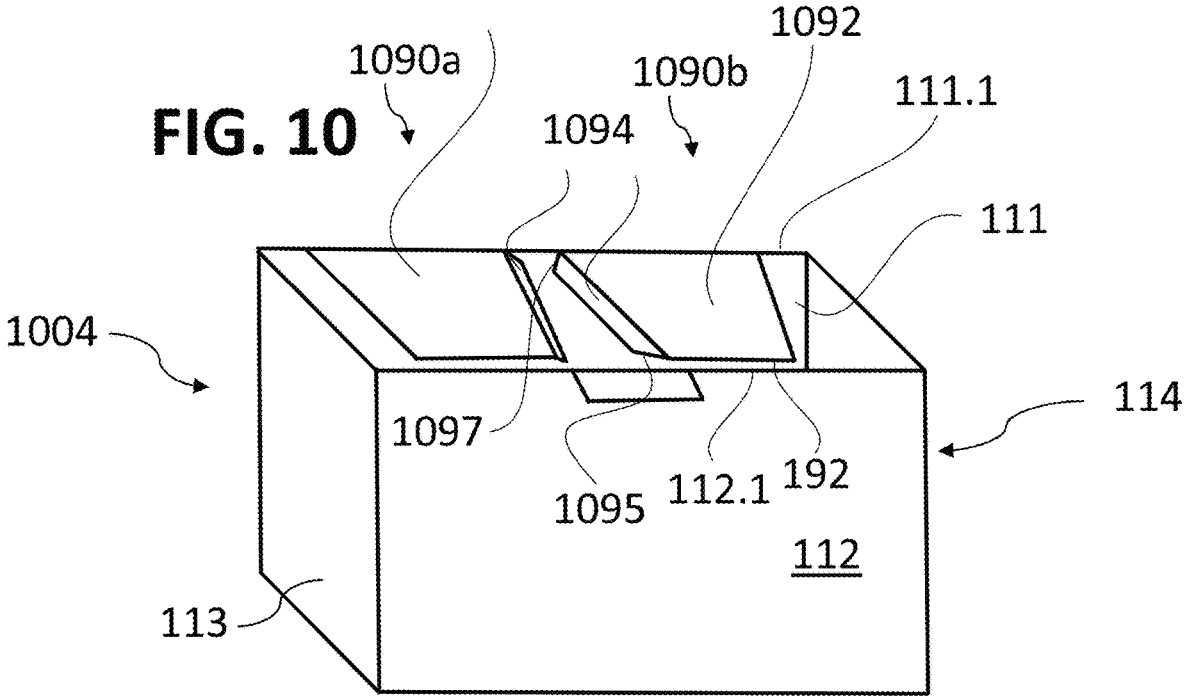
FIG. 10 illustrates an example of a box.

FIG. 10 shows an example of a box 1004. The various aspects of the box and lid discussed in relation to the previous figures may apply.

This figure illustrates that more than one top flap may be provided.

The top flaps 1090*a*, 1090*b* are directly hinged at the top edge 111.1 of the first sidewall 111. The top flaps 1090*a*, 1090*b* may be integral with the sidewall, i.e., formed from a same sheet of material. The top flaps 1090*a*, 1090*b* comprise a main flap portion 1092 and an inclined flap portion 1094. The inclined flap portion is angled with respect to the main flap portion 1092. The angle of inclination can be comprised between 20 degrees and 90 degrees. The inclined flap portion 1094 increases the rigidity of the top flap 1090 and allows for a higher degree of reciprocal feedback force.

The inclined flap portion 1094 comprises an edge 1095 on a distal side of the flap. This edge may be aligned with the distal edge 192 to provide some support against the sidewall 112. The corner between the edges of the inclined flap portion may be rounded to facilitate insertion of the inclined flap portion in the box as the top flap is folded down. In the illustrated example, the edge 1095 is angled with respect to the distal edge 192. As the top flap 1094 is folded down, the edge 1095 may contact the top edge 112.1 of the second sidewall (as the second sidewall may be deformed), and the angle of the edge 1095 will help the top flap 1094 penetrating in the cavity of the box.

The inclined flap portion 1094 further comprises an edge 1097 that abuts against the first sidewall 111. This contact prevents the top flap 1090 from being pushed further down beyond the closed orientation.

There may be enough space between the two top flaps 1090*a*, 1090*b* for a user to grasp detergent products with his/her hand. This would render the opening of the top flaps optional for a user wanting to take detergent product out of the box. The space between the top flaps may have a V-shape.

Although FIG. 10 shows two top flaps 1090*a*, 1090*b*, the reader will understand that more than two top flaps may be arranged.

Also, the position of the inclined portions relative to the main portion may be modified. For instance, the top flap 1090*b* could be modified to have an inclined portion closer to the fourth sidewall 114.

It should also be understood that each top flap 1090*a*, 1090*b* can be provided with a second inclined portion of similar or distinct shape.

In an example, one or both of the top flaps 1090 can extend from the second sidewall 112 rather than from the first sidewall 111. The clearance 194 that allows the top flap to be folded and that is small enough to enable the reciprocal feedback force is in such a case arranged between the top flap and the first sidewall 111.

The clearance between a distal edge of a top flap and the respectively corresponding sidewall may be equal to or different than the clearance between a distal edge of another top flap and the respectively corresponding sidewall.

Figure 11:
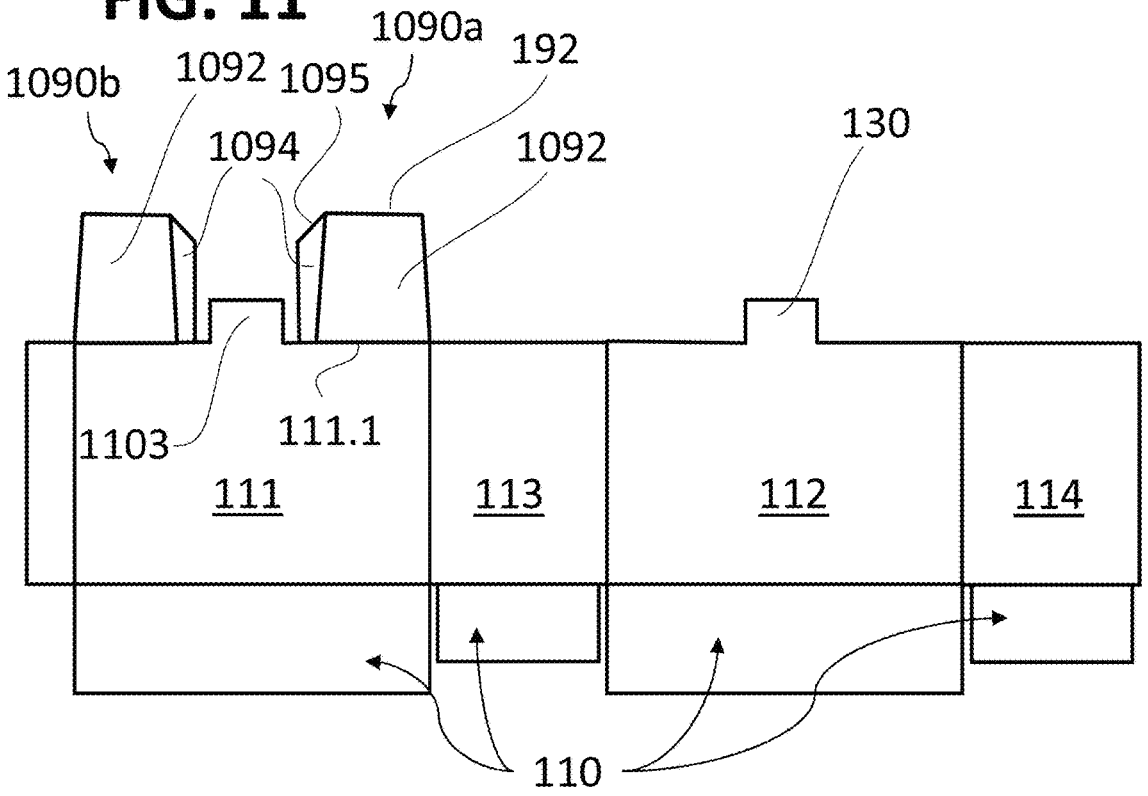
FIG. 11 illustrates an example of a box blank.

FIG. 11 shows a blank which may correspond to the box of FIG. 10. This blank shows that in some examples, the entire box may be made from a single sheet of material (e.g., paper-based material). In this example, a second actuator 1103 is directly formed by a tab protruding from the first sidewall 111 and the specific (first) actuator 130 is directly formed by a tab protruding from the second sidewall 112. In this illustration, the top flaps 1090*a*, 1090*b* extend directly from the first sidewall 111 and are separated from the first sidewall 111 by a crease line 111.1. Hence, in this example, the top flap is not intended to be made separately from the box and then glued to the box. The inclined flap portions 1094 are separated from the main portions 1092 by a crease line. The inclined flap portions 1094 are not connected to the first sidewall 111, so as to allow their inclination with respect to the main portions 1092 when the main portions 1092 are folded along the crease lines 111.1.

In this example, as the actuators 130, 1103 and the top flaps are integral with the sidewalls and the base, the box blank is substantially flat, having a homogeneous thickness. This is beneficial for the process, as the blanks can be stacked onto one another to form a pile of blanks that is easier to form, the stack being stable and safely transportable.

As discussed above, the location and number of actuators (130, 1103) may vary. Also, as noted above, the number and location of top flaps 1090 may vary.

Figure 12:
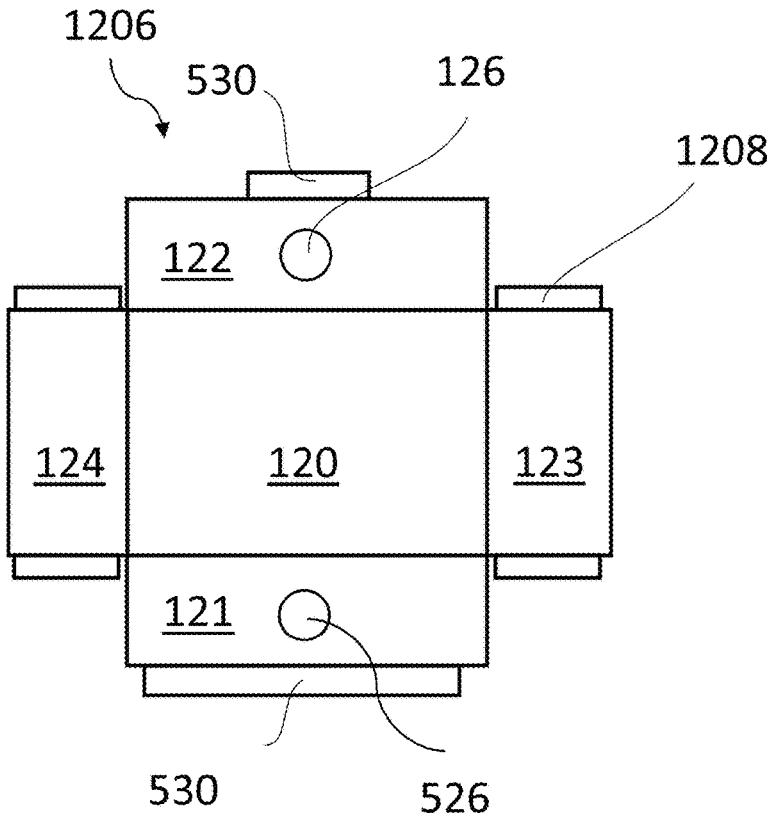
FIG. 12 illustrates an example of a lid blank.

FIG. 12 shows a lid blank 1206 designed for forming a lid suitable for cooperating with a box made from the box blank of FIG. 11. To facilitate the understanding of the drawing, the same numbers are used for the panels or flaps of the blank shown on this figure as for the lid shown on FIG. 5. The lid blank 1206 comprises a top panel 120 configured to make the top 120 of the lid, and side panels 121, 122, 123, 124 configured to make the flanks of the lid. Actuation areas 126, 526 are arranged in the panels 121, 122. Tabs 530 extend from the panels 121, 122 and are configured to be folded in the lid and to cooperate with the actuators 130, 1103. FIG. 12 shows that the tabs 530 may have various shapes and are at least as wide as the respective actuators 130, 1103. The lid blank 1206 also comprises side flaps 1208 intended to be covered with glue, to enable the lid forming a substantially parallelepipedal shape. Other positions for the side flaps 1208 are equally possible (for instance, they can extend from the panels 121, 122).

Figure 13:
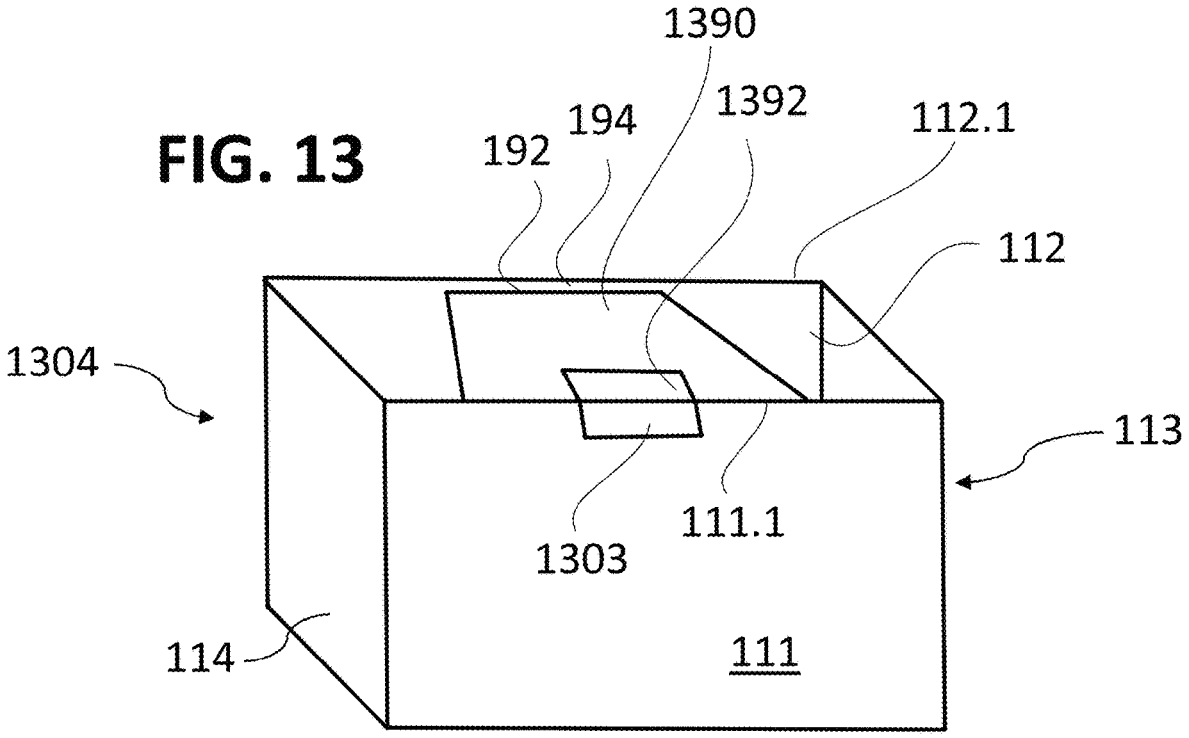
FIG. 13 illustrates an example of a box.

FIG. 13 shows an example of a box 1304. The various aspects of the box and lid discussed in relation to the previous figures may apply.

In this example, the top flap 1390 extends directly from the sidewall 111. In this example, an actuator (the specific actuator or a second actuator) 1303 can be formed by a tab that is folded and optionally glued to the sidewall 111. The actuator 1303 is formed by tearing off a precut line (or a line of weakness) arranged in the top flap 1390. In other words, a recess 1392 is formed in the top flap 1390 and the material that is tear-off from the top flap constitutes the actuator 1303. The recess and the actuator thereby have a complementary shape.

Figure 14:
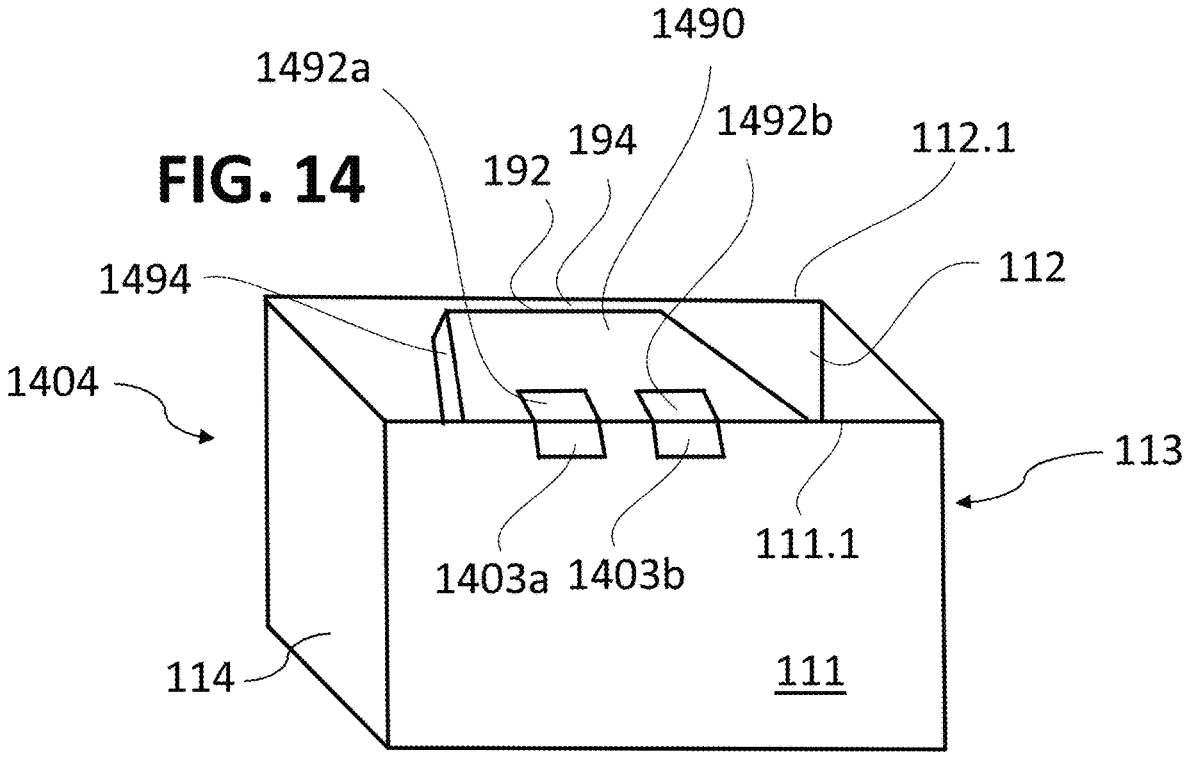
FIG. 14 illustrates an example of a box.

FIG. 14 shows an example of a box 1404. The various aspects of the box and lid discussed in relation to the previous figures may apply.

In this example, a single top flap 1490 has two recesses 1492*a*, 1492*b* which result from tearing off material from the top flap 1490 to form two actuators 1403*a*, 1403*b*. The two actuators 1403*a*, 1403*b* are thus constituted by tabs that are folded and potentially glued to the sidewall 111. The two actuators 1403*a*, 1403*b* may be close to each other so as to be unlockable by actuation in a single actuation area, or may be distant, so as to be unlockable by actuation of a pressure in two distinct actuation areas.

The reader will understand that the number of actuators may be higher than two.

Also, the reader will understand that, although FIG. 14 shows two actuators formed by tearing off material from a single top flap, the two or more actuators may be formed from two or more top flaps (i.e., one or more actuators per top flap).

As noted above, the top flaps may extend from opposite sidewalls and hence each top flap may be used to form actuators disposed at opposite sides of the box.

FIG. 14 also illustrates that an inclined tab portion 1494 can optionally be arranged in combination with the fact that a single top flap extends directly from the sidewall 111.

Figure 15:
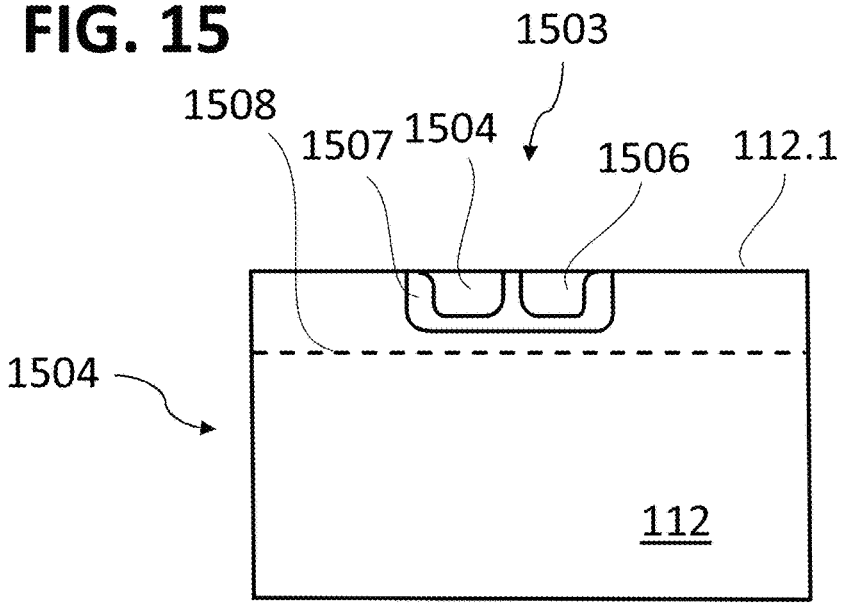
FIG. 15 illustrates an example of a box.

FIG. 15 shows a front view of a box 1504. The various aspects of the box and lid discussed in relation to the previous figures may apply.

In this example, the (specific or second) actuator 1503 is formed by two tabs 1504, 1506 surrounded by a cut-out area 1507. The sheet of material constituting the box 1504 is folded along line 112.1 of second sidewall 112 and has a distal edge shown in dotted line 1508. Hence, the back side of the folded portion (ending with the edge 1508), is visible through the cut-out 1507.

Figure 16:
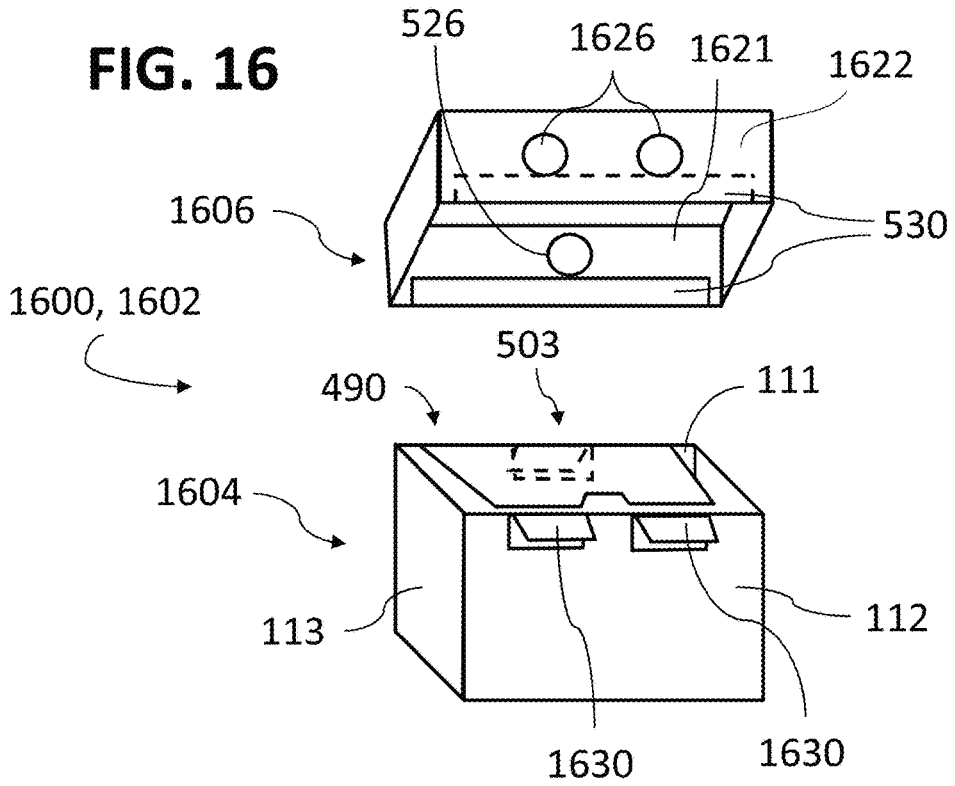
FIG. 16 illustrates an example of a consumer product.

FIG. 16 shows an example of a consumer product 1600 with a container 1602 made of a box 1604 and a lid 1606. The various aspects of the box and lid discussed in relation to the previous figures may apply.

In this example, the lid comprises one actuation area 526 arranged on a first flank 1621 of the lid 1606 and two actuation areas 1626 arranged on a second flank 1622 of the lid 1606, opposite the first flank 1621. As described in relation to FIG. 5, a tab 530 of the lid cooperates with an actuator 503 protruding from the first sidewall 111 and the actuation area 526 enables to release the engagement of the tab 530 with the actuator 503. Similarly, two actuators 1630 arranged at the second sidewall 112 are intended to cooperate with a tab 530 of the lid arranged inwardly of the flank 1622. The two actuation areas 1626 are aimed to face two actuators 1630 so as to enable two fingers of an adult user's hand to release the engagement of the tab 530 from the actuators 1630.

FIG. 16 also shows that the top flap may (but does not has to) be provided with a recess as discussed in relation to FIG. 4.

Figure 17:
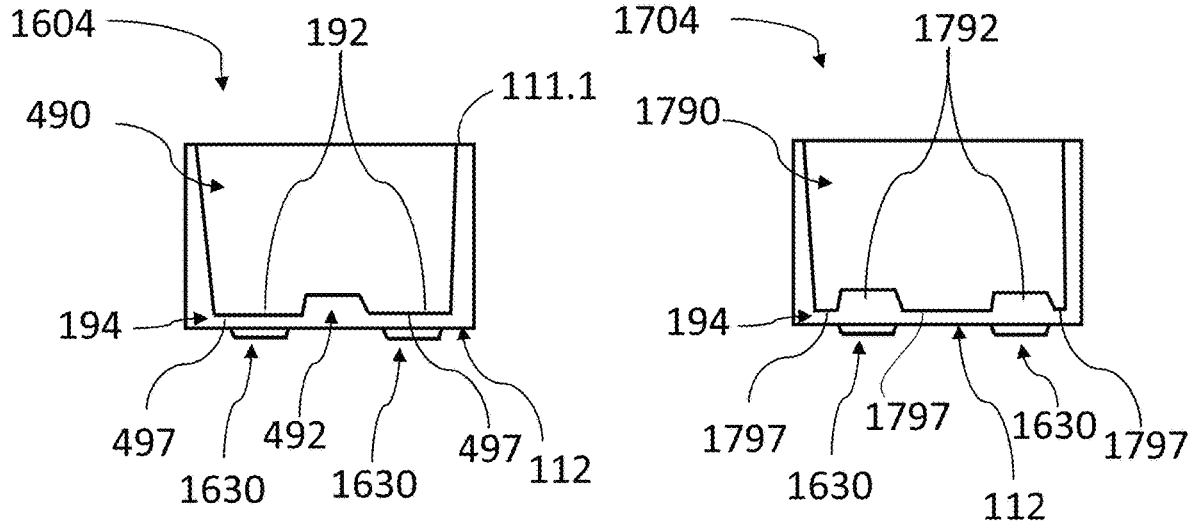
FIG. 17 illustrates two examples of a box.

FIG. 17 illustrates two examples of top flaps which may be used in combination with the two-actuator example of FIG. 16. On the left-hand side, the top flap 490 has a recess 492 that is positioned (in the horizontal direction of FIG. 17) between the two actuators 1630. The two contact locations 497 (contact under application of the actuation pressure) between the distal edge 192 of the top flap 490 and the second sidewall 112 are facing the actuators 1630. On the right-hand side is an alternative design, where the top flap 1790 has two recesses 1792 facing the actuators 1630, while three contact locations 1797 are offset with regards to the actuators 1630. In some examples, the three contact locations 1797 have a different width. For instance, the central contact location 1797 may be wider or thinner than the other two contact locations 1797. In some examples, there may be a respective clearance 194 between the distinct contact locations 1797 and the sidewall 112. For instance, the clearance 194 may be greater between the central contact location 1797 and the second sidewall 112 than the clearance 194 between the other two contact locations 1797 and the sidewall 112. In other words, some of the contact locations 1797 may be offset (in a vertical direction on FIG. 17) with respect to some other contact locations.

As noted above, the number of recesses of the top flap, the number of contact locations and the number of actuators/actuating areas on each side of the box may be altered appropriately. For example, considerations such as the robustness, the thickness of the sidewalls, or the size of the container may impact the number of these items.

Figure 18:
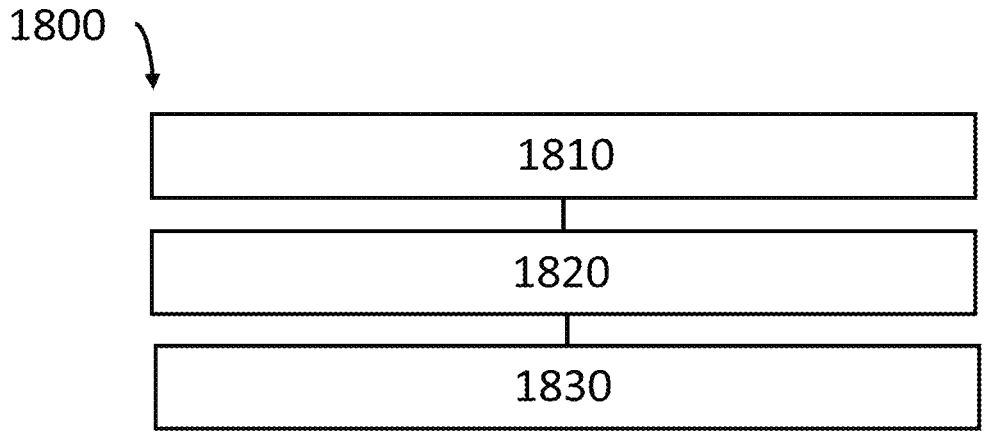
FIG. 18 illustrates an example method.

FIG. 18 shows a method 1800 of operating a consumer product having any number of aspects discussed above. In a first step 1810, as the lid is in the closed position, an actuation pressure is applied at the specific actuation area to displace the specific actuator from the locking position to the opening position. This results in the deformation of at least one of the sidewalls and the clearance 194 is thereby reduced until the second sidewall 112 contacts the distal end 192.

As the second sidewall 112 contacts the distal end 192, haptic feedback (a reciprocal feedback force) is generated. The user thus understands intuitively that he/she may proceed to the next step 1820, i.e., pulling the lid in a direction opposite the base.

The stiffness of the top flap may be sufficient for stopping the second sidewall from bending further under the actuation pressure applied by the adult hand. Hence, an adult could not be mistaken, irrespective of his/her strength, that the lock is unlocked.

After having removed the lid away from the opening, either by pivoting the lid, or separating the lid from the box, the user may want to access the detergent product laying in the box. In some examples, accessing the detergent product requires the step 1830 of folding up the top flap.

As shown in relation with FIG. 10, among others, in some examples, the user may access detergent product without having to fold the top flap up.

The present disclosure also relates to a closing method which consists in folding down the top flap and sliding (or pivoting) the lid down until the lock is engaged. The lock is engaged automatically by the actuator springing-back into a lock position. A sound (click) can be perceived by the user, constituting audio feedback indicating the proper engagement of the lock.

In some examples, the consumer product may comprise, optionally drawn on an outer surface of the container, instructions indicating how to operate the actuator to open and close the container. Other informative, regulatory or advertising information may be provided as well. In some examples, part or all of the information may be drawn, printed or labelled on one or more of the top flap(s). The one or more top flap(s) may be configured to be teared off (e.g. with precut lines or perforations, for example near the hinge to the sidewall). In some examples, the teared off top flap may serve as a promotional coupon.

Figure 19:
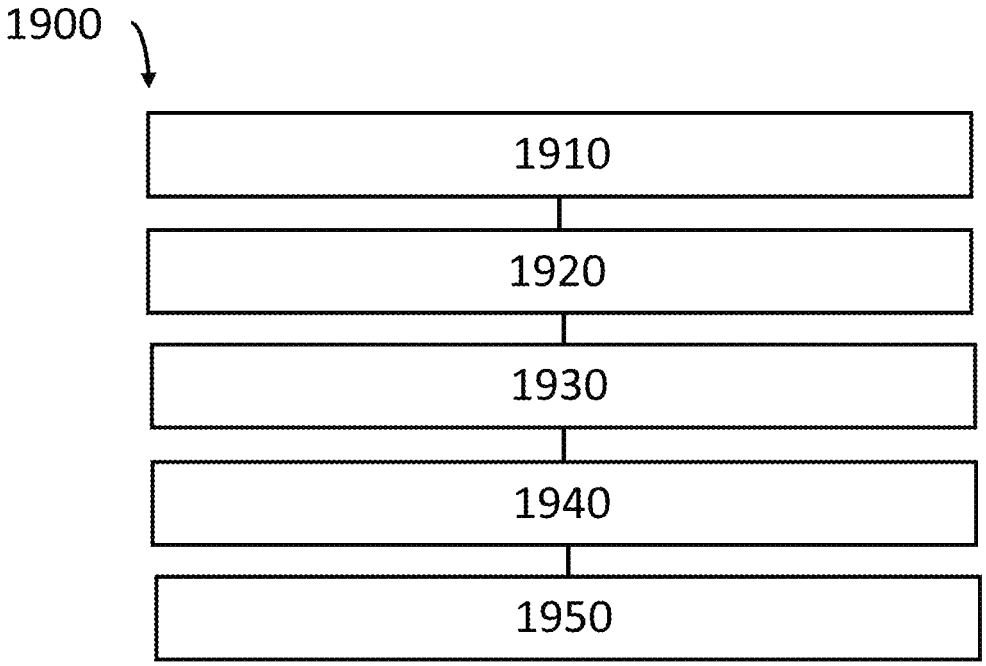
FIG. 19 illustrates an example method.

FIG. 19 illustrates a method for packaging a detergent product in a box as discussed above, to obtain a consumer product. The method 1900 comprises setting 1910 the top flap in an open orientation; placing 1920 the opening of the box below a dispensing system as the top flap is in the open orientation; dispensing 1930 the detergent product into the box as the box is below the dispensing system; folding 1940 the top flap down into the closed orientation as the detergent product is in the box; and closing 1950 the box with the lid in response to folding the top flap. Optionally, a tamper evident sticker may be placed to connect the lid to the box.

A machine and a method as discussed in patent application EP 4 242 116 A1 may be used.

Material Constituting the Container

As detailed below, the container of this disclosure can be partially or totally made from a paper material such as a material selected from paperboard, cardboard, laminates comprising at least one paper board or cardboard layer. Paperboard or cardboard comprise cellulose fibre materials or a mixture thereof. The material used to make the container may comprise other ingredients, such as colorants, protective varnishes, surface enhancement coatings, barrier coatings, preservatives, recycled fibre materials, plasticisers, UV stabilizers, oxygen barriers, perfume barriers, and moisture barriers, or a mixture thereof. In some examples, in order to provide a desired tear resistance and strength, cellulose fibres length is in a range from 0.1 to 5 mm, preferably from 1 to 3 mm. In some examples, cellulose fibres are sourced from various sources such as virgin soft or hard woods, hemp, grass, corn, bagasse, sugarcane, bamboo and others, and/or from post producer or post-consumer recycled paper and cardboard. The container may comprise areas of external or internal printing. The container may be made for example by cardboard making. Suitable container manufacturing processes may include, but are not limited to, tube forming from a flat cardboard or paperboard sheet with a gluing step, folding, or a mixture thereof. The container may be opaque or may filter some specific wavelengths, for example to protect content from external light. In some examples, the container is constructed at least in part and in some specific examples in its entirety from paper-based material. By paper-based material, we herein mean a material comprising paper. Without being bound by theory, 'paper' is to be understood as a material made from a cellulose-based pulp. Paperboard may be made from a paper-based material having a thickness and rigidity such that it does not collapse under its own weight. While paperboard should be understood as comprising a single layer of material, cardboard should be understood as comprising a plurality of paper-based material layers. In some examples, the paper-based material comprises paperboard, cardboard, or a mixture thereof, wherein preferably, cardboard comprises paperboard, corrugated fibre-board, or a mixture thereof. Corrugated fiber-board comprises a series of flutes. Each flute can be understood to be a channel. The flutes run parallel to one another, with the flute direction being the direction travelled along each channel. Further details of the material forming the container are given further below.

The paper-based material may be a laminate comprising paper, cardboard, or a mixture thereof, wherein in some examples, cardboard comprises paperboard, corrugated fiber-board, or a mixture thereof, and in some examples at least another material. In some examples, the at least another material comprises a plastic material. In some examples, the plastic material comprises polyethylene, more specifically Low-Density PolyEthylene (LDPE), polyethylene terephthalate, polypropylene, polyvinylalcohol or a mixture thereof. In some examples the plastic material comprises a copolymer from an ethylene starting monomer and vinyl alcohol, or EVOH. A barrier material may be used as the at least another material. The barrier material may be a biaxially orientated polypropylene, a metallised polyethylene terephthalate, or a mixture thereof. The at least another material may comprise a wax, a cellulose material, polyvinylalcohol, silica dioxide, casein-based materials, or a mixture thereof. In some examples, the paper-based laminate comprises more than 50%, preferably more than 85%, and more preferably more than 95% by weight of the paper-based laminate of fiber-based materials. In some examples, the barrier material may comprise plastic material having a thickness of between 10 micron and 60 microns. In some examples, the barrier material may comprise plastic material having a thickness of between 10 micron and 35 microns. The paper-based material may be a laminate.

In some examples, the internal surface of a container comprises paperboard, cardboard, or a mixture thereof, wherein, in specific examples, cardboard comprises paperboard, corrugated fiber-board and lamination of polyethylene, especially LDPE, or a mixture thereof, and, in some examples, the external surface of the container comprises the at least another material. Alternatively, the at least another material might also be laminated in-between two paper-based material layers such as the paperboard or cardboard layers as per this disclosure. Without wishing to be bound by theory this at least another material might act as a barrier for leaked liquid absorbed by the paper-based material facing the inner side of the container, to prevent or reduce a contaminating flow through a wall of the container. Other structures may be found efficient to avoid leakage from the content or to protect the content from external fluids, for example from a shower, a sink, or by handling the container with wet hands. Contamination of a wall of the container might be unsightly to consumers or may contaminate the storage area.

In some examples, the container is made of a paper-based material comprising the at least another material laminated in between two corrugated fiberboard layers.

In some examples, the material used for the container comprises a core cardboard flute material sandwiched between two plain cardboard (or paperboard) layers and polyethylene laminate.

A paperboard or cardboard layer according to this disclosure may be made from or may comprise recycled material or recycled cellulose fibres. The external surface of the container may comprise a coating or a varnish. Such a coating or varnish can help making a board repellent to water or help protecting a content such as an enclosed detergent composition from UV light. The coating or varnish could also help protecting the external surface of the lid, box or container from being contaminated by the content, for example an enclosed detergent composition, for example if leakage of a water-soluble unit dose detergent enclosing a liquid detergent composition would occur.

A coating or varnish on the internal surface can help to prevent the content to stick to the inner surface or prevent migration of inks, colorants, perfumes, non-ionics, oils, greases and other ingredients from the content into the board or inks or additives from the board onto the content. In some examples detergent resistant varnishes or coatings can be applied on areas exposed to the contents.

As noted above, the container may indeed be made from paper or cardboard material, in particular rigid cardboard material, flexible cardboard material or a mixture thereof. In some examples, the material forming the container or the cover has a wall thickness of more than 220 microns and of less than 3 mm. In some examples, the material forming the container has a thickness of more than 1 mm and of less than 2 mm. In some examples, the material forming the container is folded on itself, for example to reinforce parts of or the whole of the box or the cover. The container may be made from paper materials, bio-based material, bamboo fibres, cellulose fibres, cellulose based or fibre-based materials, or a mixture thereof. The container may be made from materials comprising recycled materials, for example recycled cellulose fibre-based materials. In some examples, in order to facilitate opening, the cover may be entirely separated from the box when open, and the cover weighs less than 200 g, preferably less than 100 g, even more preferably less than 80 g, and more than 10 g, more preferably more than 30 g, even more preferably more than 40 g, in order to obtain a sufficiently robust cover structure.

In some examples, the container is made of a corrugated cardboard layer, the corrugated cardboard layer comprising flutes, the flutes preferably running parallel to a vertical direction (for the sidewalls, and a respective corresponding direction for the top flap(s) and the base). The flutes reinforce the strength of the container.

Detergent Composition

In some examples, the consumer product comprises at least one water-soluble unit dose article and the container. The consumer product can be sold 'as is', in other words the consumer product is the item that the consumer picks up from the shelf. Alternatively, the consumer product could be housed as one unit of a multi-component product. For example, more than one consumer product could be housed within an outer package and the multiple packaged consumer products sold together in a single purchase. The consumer product may comprise aesthetic elements, for example shrink sleeves or labels attached to the container. Alternatively, the container may be coloured or printed with aesthetic elements or informative print such as usage instructions.

In some examples a water-soluble unit dose article comprises at least one water-soluble film orientated to create at least one-unit dose internal compartment, wherein the at least one-unit dose internal compartment comprises a detergent composition. The water-soluble film and the detergent composition are described in more detail below. In some examples the consumer product comprises at least one water-soluble unit dose article, in some cases at least two water-soluble unit dose articles, in some cases at least 10 water-soluble unit dose articles, in some cases at least 20 water-soluble unit dose articles, in some cases at least 30 water-soluble unit dose articles, in some cases at least 40 water-soluble unit dose articles, in some cases at least 45 water-soluble unit dose articles. A water-soluble unit dose article is in some examples in the form of a pouch. A water-soluble unit dose article comprises in some examples a unitary dose of a composition as a volume sufficient to provide a benefit in an end application. The water-soluble unit dose article comprises in some examples one water-soluble film shaped such that the unit-dose article comprises at least one internal compartment surrounded by the water-soluble film. The at least one compartment comprises a cleaning composition. The water-soluble film is sealed such that the cleaning composition does not leak out of the compartment during storage. However, upon addition of the water-soluble unit dose article to water, the water-soluble film dissolves and releases the contents of the internal compartment into the wash liquor. The unit dose article may comprise more than one compartment, at least two compartments, or at least three compartments, or at least four compartments, or even at least five compartments. The compartments may be arranged in superposed orientation, i.e. one positioned on top of the other. Alternatively, the compartments may be positioned in a side-by-side orientation, i.e. one orientated next to the other. The compartments may be orientated in a 'tyre and rim' arrangement, i.e. a first compartment is positioned next to a second compartment, but the first compartment at least partially surrounds the second compartment, but does not completely enclose the second compartment. Alternatively, one compartment may be completely enclosed within another compartment. In some examples the unit dose article comprises at least two compartments, one of the compartments being smaller than the other compartment. In some examples the unit dose article comprises at least three compartments, two of the compartments may be smaller than the third compartment, and in some examples the smaller compartments being superposed on the larger compartment. The superposed compartments are in some examples orientated side-by-side. In some examples each individual unit dose article may have a weight of between 10 g and 40 g, or even between 15 g and 35 g. The water-soluble film may be soluble or dispersible in water. Prior to be being formed into a unit dose article, the water-soluble film has in some examples a thickness of from 20 to 150 micron, in other examples 35 to 125 micron, in further examples 50 to 110 micron, in yet further examples about 76 micron. Example water soluble film materials comprise polymeric materials. The film material can, for example, be obtained by casting, blow-moulding, extrusion or blown extrusion of the polymeric material. In some examples, the water-soluble film comprises polyvinyl alcohol homopolymer or polyvinyl alcohol copolymer, for example a blend of polyvinylalcohol homopolymers and/or polyvinylalcohol copolymers, for example wherein the polyvinyl alcohol copolymers are selected from sulphonated and carboxylated anionic polyvinylalcohol copolymers especially carboxylated anionic polyvinylalcohol copolymers, for example the water-soluble comprises a blend of a polyvinylalcohol homopolymer and a carboxylated anionic polyvinylalcohol copolymer, or alternatively a blend of polyvinyl alcohol homopolymers. Alternatively the polyvinyl alcohol in the water-soluble film consists of an anionic polyvinylalcohol copolymer, especially a carboxylated polyvinylalcohol copolymer. In some examples water soluble films are those supplied by Monosol under the trade references M8630, M8900, M8779, M8310. In some examples the film may be opaque, transparent or translucent. The film may comprise a printed area. The area of print may be achieved using techniques such as flexographic printing or inkjet printing. The film may comprise an aversive agent, for example a bittering agent. Suitable bittering agents include, but are not limited to, naringin, sucrose octaacetate, quinine hydrochloride, denatonium benzoate, or mixtures thereof. Example levels of aversive agent include, but are not limited to, 1 to 5000 ppm, 100 to 2500 ppm, or 250 to 2000 ppm. The water-soluble film or water-soluble unit dose article or both may be coated with a lubricating agent. In some examples, the lubricating agent is selected from talc, zinc oxide, silicas, siloxanes, zeolites, silicic acid, alumina, sodium sulphate, potassium sulphate, calcium carbonate, magnesium carbonate, sodium citrate, sodium tripolyphosphate, potassium citrate, potassium tripolyphosphate, calcium stearate, zinc stearate, magnesium stearate, starch, modified starches, clay, kaolin, gypsum, cyclodextrins or mixtures thereof.

In some examples the container comprises a first part, wherein the first part comprises a first compartment in which the at least one water-soluble unit dose article is contained. In some examples the first compartment comprises at least two water-soluble unit dose articles. The first compartment may comprise between 1 and 80 water-soluble unit dose articles, between 1 and 60 water-soluble unit dose articles, between 1 and 40 water-soluble unit dose articles, or between 1 and 20 water-soluble unit dose articles. The volume of the first compartment may be between 500 ml and 5000 ml, in some examples between 800 ml and 4000 ml.

In some examples the detergent product comprises a detergent composition. The detergent composition may be a laundry detergent composition, an automatic dishwashing composition, a hard surface cleaning composition, or a combination thereof. The detergent composition may comprise a solid, a liquid or a mixture thereof. The term liquid includes a gel, a solution, a dispersion, a paste, or a mixture thereof. The solid may be a powder. By powder we herein mean that the detergent composition may comprise solid particulates or may be a single homogenous solid. In some examples, the powder detergent composition comprises particles. This means that the powder detergent composition comprises individual solid particles as opposed to the solid being a single homogenous solid. The particles may be free-flowing or may be compacted. A laundry detergent composition can be used in a fabric hand wash operation or may be used in an automatic machine fabric wash operation, for example in an automatic machine fabric wash operation. Example laundry detergent compositions comprise a non-soap surfactant, wherein the non-soap surfactant comprises an anionic non-soap surfactant and a non-ionic surfactant. In some examples, the laundry detergent composition comprises between 10% and 60%, or between 20% and 55% by weight of the laundry detergent composition of the non-soap surfactant. Example weight ratio of non-soap anionic surfactant to nonionic surfactant are from 1:1 to 20:1, from 1.5:1 to 17.5:1, from 2:1 to 15:1, or from 2.5:1 to 13:1. Example non-soap anionic surfactants comprises linear alkylbenzene sulphonate, alkyl sulphate or a mixture thereof. Example weight ratio of linear alkylbenzene sulphonate to alkyl sulphate are from 1:2 to 9:1, from 1:1 to 7:1, from 1:1 to 5:1, or from 1:1 to 4:1. Example linear alkylbenzene sulphonates are $C_{10}$-$C_{16}$ alkyl benzene sulfonic acids, or $C_1$-$C_{14}$ alkyl benzene sulfonic acids. By 'linear', we herein mean the alkyl group is linear. Example alkyl sulphate anionic surfactant may comprise alkoxylated alkyl sulphate or non-alkoxylated alkyl sulphate or a mixture thereof. Example alkoxylated alkyl sulphate anionic surfactant comprise an ethoxylated alkyl sulphate anionic surfactant. Example alkyl sulphate anionic surfactant may comprise an ethoxylated alkyl sulphate anionic surfactant with a mol average degree of ethoxylation from 1 to 5, from 1 to 3, or from 2 to 3. Example alkyl sulphate anionic surfactant may comprise a non-ethoxylated alkyl sulphate and an ethoxylated alkyl sulphate wherein the mol average degree of ethoxylation of the alkyl sulphate anionic surfactant is from 1 to 5, from 1 to 3, or from 2 to 3. Example alkyl fraction of the alkyl sulphate anionic surfactant are derived from fatty alcohols, oxo-synthesized alcohols, Guerbet alcohols, or mixtures thereof. In some examples, the laundry detergent composition comprises between 10% and 50%, between 15% and 45%, between 20% and 40%, or between 30% and 40% by weight of the laundry detergent composition of the non-soap anionic surfactant. In some examples, the non-ionic surfactant is selected from alcohol alkoxylate, an oxo-synthesised alcohol alkoxylate, Guerbet alcohol alkoxylates, alkyl phenol alcohol alkoxylates, or a mixture thereof. In some examples, the laundry detergent composition comprises between 0.01% and 10%, between 0.01% and 8%, between 0.1% and 6%, or between 0.15% and 5% by weight of the liquid laundry detergent composition of a non-ionic surfactant. In some examples, the laundry detergent composition comprises between 1.5% and 20%, between 2% and 15%, between 3% and 10%, or between 4% and 8% by weight of the laundry detergent composition of soap, in some examples a fatty acid salt, in some examples an amine neutralized fatty acid salt, wherein in some examples the amine is an alkanolamine for example selected from monoethanolamine, diethanolamine, triethanolamine or a mixture thereof, in some examples monoethanolamine. In some examples, the laundry detergent composition is a liquid laundry detergent composition. In some examples the liquid laundry detergent composition comprises less than 15%, or less than 12% by weight of the liquid laundry detergent composition of water. In some examples, the laundry detergent composition is a liquid laundry detergent composition comprising a non-aqueous solvent selected from 1,2-propanediol, dipropylene glycol, tripropyleneglycol, glycerol, sorbitol, polyethylene glycol or a mixture thereof. In some examples, the liquid laundry detergent composition comprises between 10% and 40%, or between 15% and 30% by weight of the liquid laundry detergent composition of the non-aqueous solvent. In some examples, the laundry detergent composition comprises a perfume. In some examples, the laundry detergent composition comprises an adjunct ingredient selected from the group comprising builders including enzymes, citrate, bleach, bleach catalyst, dye, hueing dye, brightener, cleaning polymers including alkoxylated polyamines and polyethyleneimines, soil release polymer, surfactant, solvent, dye transfer inhibitors, chelant, encapsulated perfume, polycarboxylates, structurant, pH trimming agents, and mixtures thereof. In some examples, the laundry detergent composition has a pH between 6 and 10, between 6.5 and 8.9, or between 7 and 8, wherein the pH of the laundry detergent composition is measured as a 10% product concentration in demineralized water at 20° C. When liquid, the laundry detergent composition may be Newtonian or non-Newtonian. In some examples, the liquid laundry detergent composition is non-Newtonian. Without wishing to be bound by theory, a non-Newtonian liquid has properties that differ from those of a Newtonian liquid, more specifically, the viscosity of non-Newtonian liquids is dependent on shear rate, while a Newtonian liquid has a constant viscosity independent of the applied shear rate. The decreased viscosity upon shear application for non-Newtonian liquids is thought to further facilitate liquid detergent dissolution. The liquid laundry detergent composition described herein can have any suitable viscosity depending on factors such as formulated ingredients and purpose of the composition.

Examples of the Consumer Product of the Present Disclosure $1^{st}$ aspect, a consumer product comprises a detergent product and a container, the container comprising: a box containing the detergent product, the box comprising: a base; sidewalls extending from the base, each sidewall having a top edge opposite the base; an opening opposite the base; and a top flap connected to a sidewall, the top flap being optionally hinged to a top portion of a first sidewall of the sidewalls, the top flap being optionally foldable between an open orientation and a closed orientation, wherein the top flap covers at least part of the opening when in the closed orientation, the top flap having a distal edge separated from a second sidewall of the sidewalls opposite the first sidewall by a clearance, the clearance optionally being comprised between 0.1 mm and 5 mm; a lid configured for removably covering the opening of the box, the lid optionally comprising a top and flanks, the top covering the opening and the flanks covering a specific portion of the first sidewall or of the second sidewall as the lid assumes a closed position; and a lock configured to releasably maintain the lid in the closed position, wherein the second sidewall contacts the distal edge if the box and/or the first sidewall and/or the second sidewall is deformed, preferably under applying an actuation pressure, by an adult user hand.

In a $2^{nd}$ aspect to be considered independently from the previous aspect or in combination with the previous aspect, a consumer product comprises a lock comprising: a specific actuator connected to the specific portion of the first or second sidewall and moveable between a locking position and an opening position by applying an actuation pressure onto the specific actuator; and a specific actuation area arranged in a specific flank of the flanks, the specific actuation area facing the specific actuator and permitting displacing the specific actuator from the locking position to the opening position by applying the actuation pressure at the specific actuation area as the lid is in the closed position, wherein, the clearance is such that, as the actuation pressure is applied, the second sidewall contacts the distal edge.

In a 3$^{rd}$ aspect, to be considered independently from the previous aspects or to be considered in combination with any of the previous aspects, a consumer product comprises a detergent product and a container, the container comprising: a box containing the detergent product, the box comprising: a base; sidewalls extending from the base, each sidewall having a top edge opposite the base; an opening opposite the base; and a top flap connected to a sidewall, the top flap being optionally hinged to a top portion of a first sidewall of the sidewalls, the top flap being optionally foldable between an open orientation and a closed orientation, wherein the top flap covers at least part of the opening when in the closed orientation, the top flap having a distal edge separated from a second sidewall of the sidewalls opposite the first sidewall by a clearance; a lid configured for removably covering the opening of the box, the lid optionally comprising a top and flanks, the top covering the opening and the flanks covering a specific portion of the first sidewall or of the second sidewall as the lid assumes a closed position; and a lock configured to releasably maintain the lid in the closed position, the lock comprising: a specific actuator connected to the specific portion of the first or second sidewall and moveable between a locking position and an opening position by applying an actuation pressure onto the specific actuator; and a specific actuation area arranged in a specific flank of the flanks, the specific actuation area facing the specific actuator and permitting displacing the specific actuator from the locking position to the opening position by applying the actuation pressure at the specific actuation area as the lid is in the closed position, wherein the top flap comprises a proximal flap portion connected to the top portion of the first sidewall and a main flap portion comprising the distal edge and being hinged to the proximal flap portion, such that as the top flap is in the closed orientation the main flap portion is offset from the top edges of the sidewalls towards the base in a longitudinal direction of the container.

In a 4th aspect, to be considered independently from the previous aspects or to be considered in combination with any of the previous aspects, a consumer product comprises a detergent product and a container, the container comprising: a box containing the detergent product, the box comprising: a base; sidewalls extending from the base, each sidewall having a top edge opposite the base; an opening opposite the base; and a top flap connected to a sidewall, the top flap being optionally hinged to a top portion of a first sidewall of the sidewalls, the top flap being optionally foldable between an open orientation and a closed orientation, wherein the top flap covers at least part of the opening when in the closed orientation, the top flap having a distal edge separated from a second sidewall of the sidewalls opposite the first sidewall by a clearance; a lid configured for removably covering the opening of the box, the lid optionally comprising a top and flanks, the top covering the opening and the flanks covering a specific portion of the first sidewall or of the second sidewall as the lid assumes a closed position; and a lock configured to releasably maintain the lid in the closed position, the lock comprising: a specific actuator connected to the specific portion of the first or second sidewall and moveable between a locking position and an opening position by applying an actuation pressure onto the specific actuator; and a specific actuation area arranged in a specific flank of the flanks, the specific actuation area facing the specific actuator and permitting displacing the specific actuator from the locking position to the opening position by applying the actuation pressure at the specific actuation area as the lid is in the closed position, wherein the top flap comprises a distal flap hinged to the distal edge and adapted to be folded towards the top edge of the second sidewall as the top flap is in the closed orientation.

In a 5$^{th}$ aspect, to be considered independently from the previous aspects or to be considered in combination with any of the previous aspects, a consumer product comprises a detergent product and a container, the container comprising: a box containing the detergent product, the box comprising: a base; sidewalls extending from the base, each sidewall having a top edge opposite the base; an opening opposite the base; and a top flap connected to a sidewall, the top flap being optionally hinged to a top portion of a first sidewall of the sidewalls, the top flap being optionally foldable between an open orientation and a closed orientation, wherein the top flap covers at least part of the opening when in the closed orientation, the top flap having a distal edge separated from a second sidewall of the sidewalls opposite the first sidewall by a clearance; a lid configured for removably covering the opening of the box, the lid optionally comprising a top and flanks, the top covering the opening and the flanks covering a specific portion of the first sidewall or of the second sidewall as the lid assumes a closed position; and a lock configured to releasably maintain the lid in the closed position, the lock comprising: a specific actuator connected to the specific portion of the first or second sidewall and moveable between a locking position and an opening position by applying an actuation pressure onto the specific actuator; and a specific actuation area arranged in a specific flank of the flanks, the specific actuation area facing the specific actuator and permitting displacing the specific actuator from the locking position to the opening position by applying the actuation pressure at the specific actuation area as the lid is in the closed position, wherein the top edge of the second sidewall comprises at least one abutment restraining the movement of the top flap out of, or into, the closed orientation, the at least one abutment constituting preferably in a cut-out portion of the second sidewall.

In a 6$^{th}$ aspect, to be considered independently from the previous aspects or to be considered in combination with any of the previous aspects, a consumer product comprises a detergent product and a container, the container comprising: a box containing the detergent product, the box comprising: a base; sidewalls extending from the base, each sidewall having a top edge opposite the base; an opening opposite the base; and a top flap connected to a sidewall, the top flap being optionally hinged to a top portion of a first sidewall of the sidewalls, the top flap being optionally foldable between an open orientation and a closed orientation, wherein the top flap covers at least part of the opening when in the closed orientation, the top flap having a distal edge separated from a second sidewall of the sidewalls opposite the first sidewall by a clearance; a lid configured for removably covering the opening of the box, the lid optionally comprising a top and flanks, the top covering the opening and the flanks covering a specific portion of the first sidewall or of the second sidewall as the lid assumes a closed position; and a lock configured to releasably maintain the lid in the closed position, the lock comprising: a specific actuator connected to the specific portion of the first or second sidewall and moveable between a locking position and an opening position by applying an actuation pressure onto the specific actuator; and a specific actuation area arranged in a specific flank of the flanks, the specific actuation area facing the specific actuator and permitting displacing the specific actuator from the locking position to the opening position by applying the actuation pressure at the specific actuation area as the lid is in the closed position, wherein the distal edge of the top flap comprises a recess, the recess being preferably aligned with the specific actuator along a direction of the top edge of the second sidewall.

In a $7^{th}$ aspect, to be considered independently from the previous aspects or to be considered in combination with any of the previous aspects, a consumer product comprises a detergent product and a container, the container comprising: a box containing the detergent product, the box comprising: a base; sidewalls extending from the base, each sidewall having a top edge opposite the base; an opening opposite the base; and a top flap connected to a sidewall, the top flap being optionally hinged to a top portion of a first sidewall of the sidewalls, the top flap being optionally foldable between an open orientation and a closed orientation, wherein the top flap covers at least part of the opening when in the closed orientation, the top flap having a distal edge separated from a second sidewall of the sidewalls opposite the first sidewall by a clearance; a lid configured for removably covering the opening of the box, the lid optionally comprising a top and flanks, the top covering the opening and the flanks covering a specific portion of the first sidewall or of the second sidewall as the lid assumes a closed position; and a lock configured to releasably maintain the lid in the closed position, the lock comprising: a specific actuator connected to the specific portion of the first or second sidewall and moveable between a locking position and an opening position by applying an actuation pressure onto the specific actuator; and a specific actuation area arranged in a specific flank of the flanks, the specific actuation area facing the specific actuator and permitting displacing the specific actuator from the locking position to the opening position by applying the actuation pressure at the specific actuation area as the lid is in the closed position, wherein as the actuation pressure is applied, the second sidewall contacts the distal edge of the top flap at at least two contact locations, the at least two contact locations being non-contiguous.

In a $8^{th}$ aspect, to be considered independently from the previous aspects or to be considered in combination with any of the previous aspects, a consumer product comprises a detergent product and a container, the container comprising: a box containing the detergent product, the box comprising: a base; sidewalls extending from the base, each sidewall having a top edge opposite the base; an opening opposite the base; and a top flap connected to a sidewall, the top flap being optionally hinged to a top portion of a first sidewall of the sidewalls, the top flap being optionally foldable between an open orientation and a closed orientation, wherein the top flap covers at least part of the opening when in the closed orientation, the top flap having a distal edge separated from a second sidewall of the sidewalls opposite the first sidewall by a clearance; a lid configured for removably covering the opening of the box, the lid optionally comprising a top and flanks, the top covering the opening and the flanks covering a specific portion of the first sidewall or of the second sidewall as the lid assumes a closed position; and a lock configured to releasably maintain the lid in the closed position, the lock comprising: a specific actuator connected to the specific portion of the first or second sidewall and moveable between a locking position and an opening position by applying an actuation pressure onto the specific actuator; and a specific actuation area arranged in a specific flank of the flanks, the specific actuation area facing the specific actuator and permitting displacing the specific actuator from the locking position to the opening position by applying the actuation pressure at the specific actuation area as the lid is in the closed position, wherein the at least two contact locations are offset from the specific actuator by a distance in a direction of the top edge of the second sidewall, the distance being preferably comprised between 5% and 30% of a width of the container.

In a $9^{th}$ aspect, to be considered independently from the previous aspects or to be considered in combination with any of the previous aspects, a consumer product comprises a detergent product and a container, the container comprising: a box containing the detergent product, the box comprising: a base; sidewalls extending from the base, each sidewall having a top edge opposite the base; an opening opposite the base; and a top flap connected to a sidewall, the top flap being optionally hinged to a top portion of a first sidewall of the sidewalls, the top flap being optionally foldable between an open orientation and a closed orientation, wherein the top flap covers at least part of the opening when in the closed orientation, the top flap having a distal edge separated from a second sidewall of the sidewalls opposite the first sidewall by a clearance; a lid configured for removably covering the opening of the box, the lid optionally comprising a top and flanks, the top covering the opening and the flanks covering a specific portion of the first sidewall or of the second sidewall as the lid assumes a closed position; and a lock configured to releasably maintain the lid in the closed position, the lock comprising: a specific actuator connected to the specific portion of the first or second sidewall and moveable between a locking position and an opening position by applying an actuation pressure onto the specific actuator; and a specific actuation area arranged in a specific flank of the flanks, the specific actuation area facing the specific actuator and permitting displacing the specific actuator from the locking position to the opening position by applying the actuation pressure at the specific actuation area as the lid is in the closed position, wherein as the top flap is in the closed orientation, the top flap is hinged to the first sidewall such that a resisting torque comprised between 0.5 N·m/m of crease and 5 N·m/m of crease opposes its movement out of the closed orientation.

In a $10^{th}$ aspect, to be considered independently from the previous aspects or to be considered in combination with any of the previous aspects, a consumer product comprises a detergent product and a container, the container comprising: a box containing the detergent product, the box comprising: a base; sidewalls extending from the base, each sidewall having a top edge opposite the base; an opening opposite the base; and a top flap connected to a sidewall, the top flap being optionally hinged to a top portion of a first sidewall of the sidewalls, the top flap being optionally foldable between an open orientation and a closed orientation, wherein the top flap covers at least part of the opening when in the closed orientation, the top flap having a distal edge separated from a second sidewall of the sidewalls opposite the first sidewall by a clearance; a lid configured for removably covering the opening of the box, the lid optionally comprising a top and flanks, the top covering the opening and the flanks covering a specific portion of the first sidewall or of the second sidewall as the lid assumes a closed position; and a lock configured to releasably maintain the lid in the closed position, the lock comprising: a specific actuator connected to the specific portion of the first or second sidewall and moveable between a locking position and an opening position by applying an actuation pressure onto the specific actuator; and a specific actuation area arranged in a specific flank of the flanks, the specific actuation area facing the specific actuator and permitting displacing the specific actuator from the locking position to the opening position by applying the actuation pressure at the specific actuation area as the lid is in the closed position, wherein the first sidewall has a width and the top flap has a minimum width that is comprised between 20% and 99% of the width of the first sidewall.

In a 11$^{th}$ aspect, to be considered independently from the previous aspects or to be considered in combination with any of the previous aspects, a consumer product comprises a detergent product and a container, the container comprising: a box containing the detergent product, the box comprising: a base; sidewalls extending from the base, each sidewall having a top edge opposite the base; an opening opposite the base; and a top flap connected to a sidewall, the top flap being optionally hinged to a top portion of a first sidewall of the sidewalls, the top flap being optionally foldable between an open orientation and a closed orientation, wherein the top flap covers at least part of the opening when in the closed orientation, the top flap having a distal edge separated from a second sidewall of the sidewalls opposite the first sidewall by a clearance; a lid configured for removably covering the opening of the box, the lid optionally comprising a top and flanks, the top covering the opening and the flanks covering a specific portion of the first sidewall or of the second sidewall as the lid assumes a closed position; and a lock configured to releasably maintain the lid in the closed position, the lock comprising: a specific actuator connected to the specific portion of the first or second sidewall and moveable between a locking position and an opening position by applying an actuation pressure onto the specific actuator; and a specific actuation area arranged in a specific flank of the flanks, the specific actuation area facing the specific actuator and permitting displacing the specific actuator from the locking position to the opening position by applying the actuation pressure at the specific actuation area as the lid is in the closed position, wherein the top flap comprises at least one through-hole enabling an adult finger to fold the top flap open.

In a 12$^{th}$ aspect, to be considered independently from the previous aspects or to be considered in combination with any of the previous aspects, a consumer product comprises a detergent product and a container, the container comprising: a box containing the detergent product, the box comprising: a base; sidewalls extending from the base, each sidewall having a top edge opposite the base; an opening opposite the base; and a top flap connected to a sidewall, the top flap being optionally hinged to a top portion of a first sidewall of the sidewalls, the top flap being optionally foldable between an open orientation and a closed orientation, wherein the top flap covers at least part of the opening when in the closed orientation, the top flap having a distal edge separated from a second sidewall of the sidewalls opposite the first sidewall by a clearance; a lid configured for removably covering the opening of the box, the lid optionally comprising a top and flanks, the top covering the opening and the flanks covering a specific portion of the first sidewall or of the second sidewall as the lid assumes a closed position; and a lock configured to releasably maintain the lid in the closed position, the lock comprising: a specific actuator connected to the specific portion of the first or second sidewall and moveable between a locking position and an opening position by applying an actuation pressure onto the specific actuator; and a specific actuation area arranged in a specific flank of the flanks, the specific actuation area facing the specific actuator and permitting displacing the specific actuator from the locking position to the opening position by applying the actuation pressure at the specific actuation area as the lid is in the closed position, wherein the sidewalls and/or the top flap are made of a corrugated paper-based material having flutes oriented perpendicularly to the top edge of the first sidewall.

In a 13$^{th}$ aspect, to be considered independently from the previous aspects or to be considered in combination with any of the previous aspects, a consumer product comprises a detergent product and a container, the container comprising: a box containing the detergent product, the box comprising: a base; sidewalls extending from the base, each sidewall having a top edge opposite the base; an opening opposite the base; and a top flap connected to a sidewall, the top flap being optionally hinged to a top portion of a first sidewall of the sidewalls, the top flap being optionally foldable between an open orientation and a closed orientation, wherein the top flap covers at least part of the opening when in the closed orientation, the top flap having a distal edge separated from a second sidewall of the sidewalls opposite the first sidewall by a clearance; a lid configured for removably covering the opening of the box, the lid optionally comprising a top and flanks, the top covering the opening and the flanks covering a specific portion of the first sidewall or of the second sidewall as the lid assumes a closed position; and a lock configured to releasably maintain the lid in the closed position, the lock comprising: a specific actuator connected to the specific portion of the first or second sidewall and moveable between a locking position and an opening position by applying an actuation pressure onto the specific actuator; and a specific actuation area arranged in a specific flank of the flanks, the specific actuation area facing the specific actuator and permitting displacing the specific actuator from the locking position to the opening position by applying the actuation pressure at the specific actuation area as the lid is in the closed position, wherein in the closed orientation, the top flap is angled with respect to the second sidewall at an angle comprised between 70 degrees and 110 degrees.

In a 14$^{th}$ aspect, to be considered independently from the previous aspects or to be considered in combination with any of the previous aspects, a consumer product comprises a detergent product and a container, the container comprising: a box containing the detergent product, the box comprising: a base; sidewalls extending from the base, each sidewall having a top edge opposite the base; an opening opposite the base; and a top flap connected to a sidewall, the top flap being optionally hinged to a top portion of a first sidewall of the sidewalls, the top flap being optionally foldable between an open orientation and a closed orientation, wherein the top flap covers at least part of the opening when in the closed orientation, the top flap having a distal edge separated from a second sidewall of the sidewalls opposite the first sidewall by a clearance; a lid configured for removably covering the opening of the box, the lid optionally comprising a top and flanks, the top covering the opening and the flanks covering a specific portion of the first sidewall or of the second sidewall as the lid assumes a closed position; and a lock configured to releasably maintain the lid in the closed position, the lock comprising: a specific actuator connected to the specific portion of the first or second sidewall and moveable between a locking position and an opening position by applying an actuation pressure onto the specific actuator; and a specific actuation area arranged in a specific flank of the flanks, the specific actuation area facing the specific actuator and permitting displacing the specific actuator from the locking position to the opening position by applying the actuation pressure at the specific actuation area as the lid is in the closed position, wherein the specific portion of the first or second sidewall is a first portion of the first sidewall, the flanks covering a second portion of the second sidewall, wherein the specific actuator is a first actuator, and the specific actuation area arranged in a specific flank is a first actuation area arranged in a first flank, the lock further comprising: at least one second actuator connected to the second portion of the second sidewall and moveable between a locking position and an opening position by applying an actuation pressure onto the second actuator; and at least one second actuation area arranged in a second flank of the flanks, the second flank covering the second portion of the second sidewall, each of the at least one second actuation area facing a respective second actuator of the at least one second actuator and permitting displacing the respective second actuator from the locking position to the opening position by applying the actuation pressure at the respective second actuation area as the lid is in the closed position.

In a 15$^{th}$ aspect, to be considered independently from the previous aspects or to be considered in combination with any of the previous aspects, a consumer product comprises a detergent product and a container, the container comprising: a box containing the detergent product, the box comprising: a base; sidewalls extending from the base, each sidewall having a top edge opposite the base; an opening opposite the base; and a top flap connected to a sidewall, the top flap being optionally hinged to a top portion of a first sidewall of the sidewalls, the top flap being optionally foldable between an open orientation and a closed orientation, wherein the top flap covers at least part of the opening when in the closed orientation, the top flap having a distal edge separated from a second sidewall of the sidewalls opposite the first sidewall by a clearance; a lid configured for removably covering the opening of the box, the lid optionally comprising a top and flanks, the top covering the opening and the flanks covering a specific portion of the first sidewall or of the second sidewall as the lid assumes a closed position; and a lock configured to releasably maintain the lid in the closed position, the lock comprising: a specific actuator connected to the specific portion of the first or second sidewall and moveable between a locking position and an opening position by applying an actuation pressure onto the specific actuator; and a specific actuation area arranged in a specific flank of the flanks, the specific actuation area facing the specific actuator and permitting displacing the specific actuator from the locking position to the opening position by applying the actuation pressure at the specific actuation area as the lid is in the closed position, the consumer product further comprising a stopper preventing the top flap from pivoting downwards beyond the closed orientation, the stopper being: at least one protruding tab of the top flap engaging a stopper recess arranged in an internal surface of the second sidewall; or a stopper tab of the second sidewall protruding from an inner surface of the second sidewall and on which the top flap rests when in closed orientation.

In a 16$^{th}$ aspect, to be considered independently from the previous aspects or to be considered in combination with any of the previous aspects, a consumer product comprises a detergent product and a container, the container comprising: a box containing the detergent product, the box comprising: a base; sidewalls extending from the base, each sidewall having a top edge opposite the base; an opening opposite the base; and a top flap connected to a sidewall, the top flap being optionally hinged to a top portion of a first sidewall of the sidewalls, the top flap being optionally foldable between an open orientation and a closed orientation, wherein the top flap covers at least part of the opening when in the closed orientation, the top flap having a distal edge separated from a second sidewall of the sidewalls opposite the first sidewall by a clearance; a lid configured for removably covering the opening of the box, the lid optionally comprising a top and flanks, the top covering the opening and the flanks covering a specific portion of the first sidewall or of the second sidewall as the lid assumes a closed position; and a lock configured to releasably maintain the lid in the closed position, the lock comprising: a specific actuator connected to the specific portion of the first or second sidewall and moveable between a locking position and an opening position by applying an actuation pressure onto the specific actuator; and a specific actuation area arranged in a specific flank of the flanks, the specific actuation area facing the specific actuator and permitting displacing the specific actuator from the locking position to the opening position by applying the actuation pressure at the specific actuation area as the lid is in the closed position, wherein the top flap comprises a main flap portion and an inclined flap portion angled downwards with respect to the main portion.

In a 17$^{th}$ aspect, to be considered independently from the previous aspects or to be considered in combination with any of the previous aspects, a consumer product comprises a detergent product and a container, the container comprising: a box containing the detergent product, the box comprising: a base; sidewalls extending from the base, each sidewall having a top edge opposite the base; an opening opposite the base; and a top flap connected to a sidewall, the top flap being optionally hinged to a top portion of a first sidewall of the sidewalls, the top flap being optionally foldable between an open orientation and a closed orientation, wherein the top flap covers at least part of the opening when in the closed orientation, the top flap having a distal edge separated from a second sidewall of the sidewalls opposite the first sidewall by a clearance; a lid configured for removably covering the opening of the box, the lid optionally comprising a top and flanks, the top covering the opening and the flanks covering a specific portion of the first sidewall or of the second sidewall as the lid assumes a closed position; and a lock configured to releasably maintain the lid in the closed position, the lock comprising: a specific actuator connected to the specific portion of the first or second sidewall and moveable between a locking position and an opening position by applying an actuation pressure onto the specific actuator; and a specific actuation area arranged in a specific flank of the flanks, the specific actuation area facing the specific actuator and permitting displacing the specific actuator from the locking position to the opening position by applying the actuation pressure at the specific actuation area as the lid is in the closed position, wherein the top flap comprises at least one recess having a shape and the specific actuator has a shape corresponding to the shape of the at least one recess.

In a 18$^{th}$ aspect, to be considered independently from the previous aspects or to be considered in combination with any of the previous aspects, a method for opening a consumer product optionally according to any of the previous aspects comprises: applying an actuation pressure at the specific actuation area as the lid is in the closed position to displace the specific actuator from the locking position to the opening position, wherein the clearance between a distal edge of a top flap and a sidewall is such that by applying the actuation pressure, the sidewall contacts the distal end.

In a 19$^{th}$ aspect, to be considered independently from the previous aspects or to be considered in combination with any of the previous aspects, a method for opening a consumer product optionally according to any of the previous aspects comprises: pulling the lid in a direction opposite the base and/or folding up the top flap to enable access to the detergent product.

In a 20$^{th}$ aspect, to be considered independently from the previous aspects or to be considered in combination with any of the previous aspects, a method for opening a consumer product optionally according to any of the previous aspects comprises: as the actuation pressure is applied by an adult hand, the second sidewall bends until contacting the distal edge, and the top flap has a stiffness that is sufficient for stopping the second sidewall from bending further under the actuation pressure applied by the adult hand.

In a 21$^{th}$ aspect, to be considered independently from the previous aspects or to be considered in combination with any of the previous aspects, a closing method comprises folding down the top flap into a closed orientation and sliding (or pivoting) the lid down until the lock is engaged. The lock may engage automatically as the actuator springs back into a lock position. A sound (click) can be perceived by the user, constituting audio feedback indicating the proper engagement of the lock.

In a 22$^{nd}$ aspect, to be considered independently from the previous aspects or to be considered in combination with any of the previous aspects, a method for packaging a detergent product to optionally obtain a consumer product according to any of aspects 1 to 17, the method comprises optionally setting the top flap in an open orientation; placing the opening of the box below a dispensing system as the top flap is in the open orientation; dispensing the detergent product into the box as the box is below the dispensing system; optionally letting the detergent product bounce on the top flap; optionally folding the top flap down into the closed orientation as the detergent product is in the box; and closing the box with the lid in response to folding the top flap.

In a 23$^{rd}$ aspect, to be considered independently from the previous aspects or to be considered in combination with any of the previous aspects, a lid blank and/or a container blank for forming a lid and/or a box as recited in any of the aspects 1 to 17 is provided. The lid blank may comprise a main panel intended to form the top and secondary panels intended to form the flanks. Actuation area, i.e., recesses, notches, through-holes (etc.) may be provided on the secondary panels of the lid blank. The lid blank may comprise crease lines intended to facilitate folding the lid blank into a lid. The box blank may comprise main panels intended to form the sidewalls of the container. The box blank may comprise secondary panels intended to form the base and a dust flap intended to connect two sidewalls. The box blank may comprise crease lines intended to facilitate folding the box blank into a box. The box blank may comprise a top flap panel. Alternatively, the top flap panel may be independently formed, separated from the box blank. The top flap panel may then be glued to a sidewall of the blank, before or after folding the blank into a box. The box blank may comprise precut lines intended to form the actuator, optionally arranged in the top flap.

In a 24$^{th}$ aspect, to be considered independently from the previous aspects or to be considered in combination with any of the previous aspects, a container blank for forming a box is provided, in particular for forming a consumer product as in aspect 16. The container blank comprises main sidewall panels aimed at forming first and second sidewalls, and secondary sidewall panels aimed at forming lateral sidewalls. The container blank further comprises at least one top flap hinged to a respective main sidewall panel. The length of (each of) the top flap may be smaller than the width of lateral sidewalls, so as to result (once the blank is folded into a box) to a clearance between a distal edge of the top flap(s) and an opposite sidewall. The at least one top flap may be provided, each, with at least one wing flaps extending from a side of the top flap. The wing flap is aimed at building an inclined flap as recited in some of the examples above. The wing flap may have a substantially trapezoidal shape.

In a 25$^{th}$ aspect, to be considered independently from the previous aspects or to be considered in combination with any of the previous aspects, a method is provided, for forming a lid and/or a box as recited in any of the aspects 1 to 17. The method may comprise folding panels and/or flaps of the lid blank into a lid and the box blank into a box. The method may comprise folding the top flap. The method may comprise tearing off actuators from a panel of the box blank, optionally from the top flap.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm".

Every document cited herein, including any cross referenced or related patent or application and any patent application or patent to which this application claims priority or benefit thereof, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A consumer product comprising a detergent product and a container, the container comprising:

a box containing the detergent product, the box comprising:

a base;

sidewalls extending from the base, each sidewall having a top edge opposite the base;

an opening opposite the base; and a top flap hinged to a top portion of a first sidewall of the sidewalls, the top flap being foldable between an open orientation and a closed orientation, wherein the top flap covers at least part of the opening when in the closed orientation, the top flap having a distal edge separated from a second sidewall of the sidewalls opposite the first sidewall by a clearance, the clearance comprises between 0.1 mm and 5 mm;

a lid configured for removably covering the opening of the box, the lid comprising a top and flanks, the top covering the opening and the flanks covering a specific portion of the first sidewall or of the second sidewall as the lid assumes a closed position; and a lock configured to releasably maintain the lid in the closed position, the lock comprising:

a specific actuator connected to the specific portion of the first sidewall or the second sidewall and moveable between a locking position and an opening position by applying an actuation pressure onto the specific actuator; and a specific actuation area arranged in a specific flank of the flanks, the specific actuation area facing the specific actuator and permitting displacing the specific actuator from the locking position to the opening position by applying the actuation pressure at the specific actuation area as the lid is in the closed position, wherein, the clearance is such that, as the actuation pressure is applied, the second sidewall contacts the distal edge.

2. The consumer product of claim 1, wherein the top flap comprises a proximal flap portion connected to the top portion of the first sidewall and a main flap portion comprising the distal edge and being hinged to the proximal flap portion, such that as the top flap is in the closed orientation the main flap portion is offset from the top edges of the sidewalls towards the base in a longitudinal direction of the container.

3. The consumer product of claim 1, wherein the top flap comprises a distal flap hinged to the distal edge and adapted to be folded towards the top edge of the second sidewall as the top flap is in the closed orientation.

4. The consumer product of claim 1, wherein the top edge of the second sidewall comprises at least one abutment restraining the movement of the top flap out of, or into, the closed orientation.

5. The consumer product of claim 1, wherein the top edge of the second sidewall comprises at least one abutment restraining the movement of the top flap out of, or into, the closed orientation, the at least one abutment constituting in a cut-out portion of the second sidewall.

6. The consumer product of claim 1, wherein the distal edge of the top flap comprises a recess.

7. The consumer product of claim 1, wherein the distal edge of the top flap comprises a recess, the recess being aligned with the specific actuator along a direction of the top edge of the second sidewall.

8. The consumer product of claim 1, wherein as the actuation pressure is applied, the second sidewall contacts the distal edge of the top flap at at least two contact locations, the at least two contact locations being non-contiguous.

9. The consumer product of claim 8, wherein the at least two contact locations are offset from the specific actuator by a distance in a direction of the top edge of the second sidewall.

10. The consumer product of claim 8, wherein the at least two contact locations are offset from the specific actuator by a distance in a direction of the top edge of the second sidewall, the distance comprises between 5% and 30% of a width of the container.

11. The consumer product of claim 1, wherein as the top flap is in the closed orientation, the top flap is hinged to the first sidewall such that a resisting torque comprises between 0.5 N·m/m of crease and 5 N·m/m of crease opposes the movement of the top flap out of the closed orientation.

12. The consumer product of claim 1, wherein the first sidewall has a width and the top flap has a maximum width that comprises between 20% and 99% of the width of the first sidewall.

13. The consumer product of claim 1, wherein the top flap comprises at least one through-hole enabling an adult finger to fold the top flap open.

14. The consumer product of claim 1, wherein the sidewalls or the top flap are made of a corrugated paper-based material having flutes oriented perpendicularly to the top edge of the first sidewall.

15. The consumer product of claim 1, wherein in the closed orientation, the top flap is angled with respect to the second sidewall at an angle ($\alpha$) of between 70 degrees and 110 degrees.

16. The consumer product of claim 1, wherein the specific portion of the first sidewall or the second sidewall is a first portion of the first sidewall, the flanks covering a second portion of the second sidewall, wherein the specific actuator is a first actuator, and the specific actuation area arranged in a specific flank is a first actuation area arranged in a first flank, the lock further comprising:

at least one second actuator connected to the second portion of the second sidewall and moveable between a locking position and an opening position by applying an actuation pressure onto the second actuator; and at least one second actuation area arranged in a second flank of the flanks, the second flank covering the second portion of the second sidewall, each of the at least one second actuation area facing a respective second actuator of the at least one second actuator and permitting displacing the respective second actuator from the locking position to the opening position by applying the actuation pressure at the respective second actuation area as the lid is in the closed position.

17. The consumer product of claim 1, further comprising a stopper preventing the top flap from pivoting downwards beyond the closed orientation, the stopper being: at least one protruding tab of the top flap engaging a stopper recess arranged in an internal surface of the second sidewall; or a stopper tab of the second sidewall protruding from an inner surface of the second sidewall and on which the top flap rests when in closed orientation.

18. The consumer product of claim 1, wherein the top flap comprises a main flap portion and an inclined flap portion angled downwards with respect to the main portion.

19. The consumer product of claim 1, wherein the top flap comprises at least one recess having a shape and the specific actuator has a shape corresponding to the shape of the at least one recess.

20. A method for opening a consumer product according to claim 1, the method comprising:

applying an actuation pressure at the specific actuation area as the lid is in the closed position to displace the specific actuator from the locking position to the opening position, wherein the clearance is such that by applying the actuation pressure, the second sidewall contacts the distal end;

pulling the lid in a direction opposite the base; and folding up the top flap to enable access to the detergent product.

* * * * *